US005373716A

United States Patent [19]

MacNeil et al.

[11] Patent Number: 5,373,716

[45] Date of Patent: Dec. 20, 1994

[54] MULTIPOINT LOCK ASSEMBLY FOR A SWINGING DOOR

[75] Inventors: David I. MacNeil, Canyon Country; Nandor Gajer, Woodland Hills, both of Calif.

[73] Assignee: W&F Manufacturing, Inc., Glendale, Calif.

[21] Appl. No.: 961,643

[22] Filed: Oct. 16, 1992

[51] Int. Cl.[5] ..... E05B 59/00

[52] U.S. Cl. ..... 70/109; 70/92; 70/486; 70/489; 292/37; 292/92; 292/165

[58] Field of Search ..... 292/36, 37, 92, 163, 292/165, 167, 170, 336.3, 169.12, 169.14, 340, 341, 341.12, 341.13; 70/99, 100, 102, 106, 109–111, 107, 92, 120, 140, 141, 144, 145, 131, 139, 150, 151 R, 156, 157, 224, 486, 489

[56] References Cited

U.S. PATENT DOCUMENTS

| | | | |
|---|---|---|---|
| 1,078,549 | 11/1913 | Northey . | |
| 1,427,991 | 9/1922 | Whittaker | 292/341.11 |
| 1,642,501 | 9/1927 | Knell . | |
| 2,406,459 | 8/1946 | Gibson | 292/39 |
| 2,886,960 | 5/1959 | Willett et al. | 70/120 X |
| 3,498,657 | 3/1970 | Fontana | 292/34 |
| 3,672,714 | 6/1972 | Schultz | 70/107 X |
| 3,722,236 | 3/1973 | Zelenko | 70/78 |
| 3,783,658 | 1/1974 | Wada | 70/110 |
| 3,953,991 | 5/1976 | Grossman | 292/170 X |
| 4,005,886 | 2/1977 | Lirette | 292/92 X |
| 4,063,763 | 12/1977 | van Herpen | 292/39 |
| 4,156,541 | 5/1979 | Babb, Jr. et al. | 292/21 |
| 4,227,723 | 10/1980 | Rosell | 292/34 |
| 4,237,711 | 12/1980 | Kambic | 70/150 |
| 4,255,953 | 3/1981 | Dietrich et al. | 70/107 |
| 4,391,460 | 7/1983 | Bonet | 292/37 |
| 4,470,277 | 9/1984 | Uyeda | 292/36 X |
| 4,579,376 | 4/1986 | Charlton | 292/170 X |
| 4,643,005 | 2/1987 | Logas | 70/95 |
| 4,671,089 | 6/1987 | Fleming | 70/452 |
| 4,754,624 | 7/1988 | Fleming | 70/95 |
| 4,799,718 | 1/1989 | Ing | 292/36 |
| 4,840,050 | 6/1989 | Gotanda | 70/107 |
| 4,870,841 | 10/1989 | Cudd | 292/169.13 X |
| 4,945,737 | 8/1990 | Hart | 70/143 |
| 4,962,653 | 10/1990 | Kaup | 70/107 |
| 4,964,660 | 10/1990 | Prevot et al. | 292/37 |
| 4,988,133 | 1/1991 | Shih | 292/191 |
| 5,058,938 | 10/1991 | Doring | 292/45 |
| 5,290,077 | 3/1994 | Flemming | 292/35 |

FOREIGN PATENT DOCUMENTS

| | | | |
|---|---|---|---|
| 557075 | 10/1986 | Australia . | |
| 192796 | 12/1956 | Germany | 292/340 |
| 1062143 | 5/1960 | Germany . | |
| 709399 | 12/1963 | Germany . | |
| 1932638 | 6/1969 | Germany | 292/340 |
| 1559712 | 10/1969 | Germany . | |
| 2341263 | 3/1974 | Germany . | |
| 2457169 | 6/1976 | Germany | 292/340 |
| 3142959A1 | 10/1981 | Germany . | |
| 0092630A1 | 4/1982 | Germany . | |
| 0168001A2 | 7/1985 | Germany . | |
| 0356772A2 | 8/1989 | Germany . | |
| 0358971A2 | 8/1989 | Germany . | |
| 0381820A2 | 10/1989 | Germany . | |
| 0413177A1 | 2/1991 | Germany . | |
| 1544213 | 4/1976 | United Kingdom . | |
| 2122244 | 1/1984 | United Kingdom | 70/109 |

*Primary Examiner*—Peter M. Cuomo
*Assistant Examiner*—Suzanne L. Dino
*Attorney, Agent, or Firm*—Kelly Bauersfeld & Lowry

[57] ABSTRACT

An improved multipoint lock assembly is provided for securing a swinging door in a tightly closed condition. The multipoint lock assembly includes a main actuator cartridge for retracting a plurality of latch pins mounted at vertically spaced positions along a free side edge of the swinging door, in response to rotational movement of indoor and outdoor lever handles. A trigger assembly retains the latch pins in a retracted position in response to lever handle rotation to open the door, and includes a trigger pin for engaging the adjacent door jamb upon door closure to release the latch pins for spring-loaded movement to an advanced position. The advanced latch pins engage ramped strike plates on the door jamb to draw in and tightly retain the closed door against the door jamb. When the latch pins are advanced, a security deadbolt on the main actuator cartridge can be thrown to positively lock the door. When the deadbolt is thrown, a panic release mechanism permits retraction of the deadbolt and latch pins in response to rotation of the indoor lever handle, but not in response to rotation of the outdoor lever handle.

42 Claims, 16 Drawing Sheets

FIG. 1
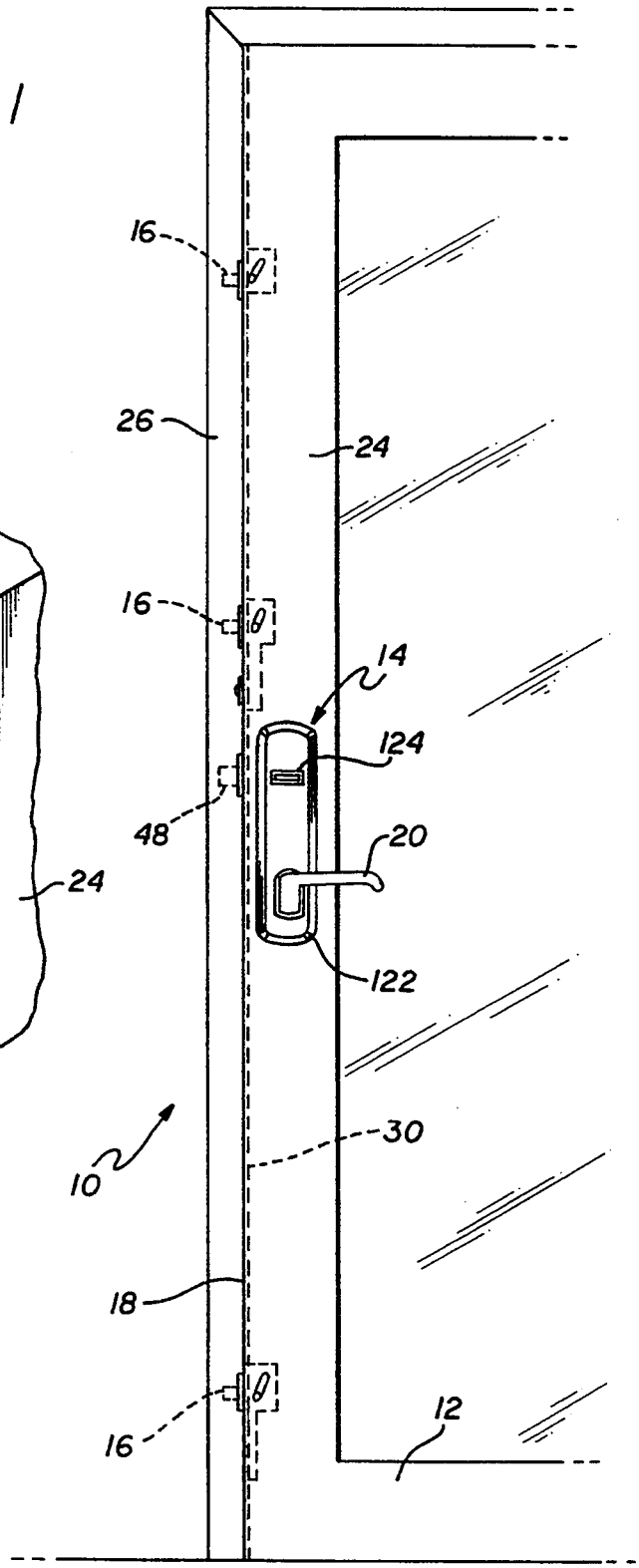
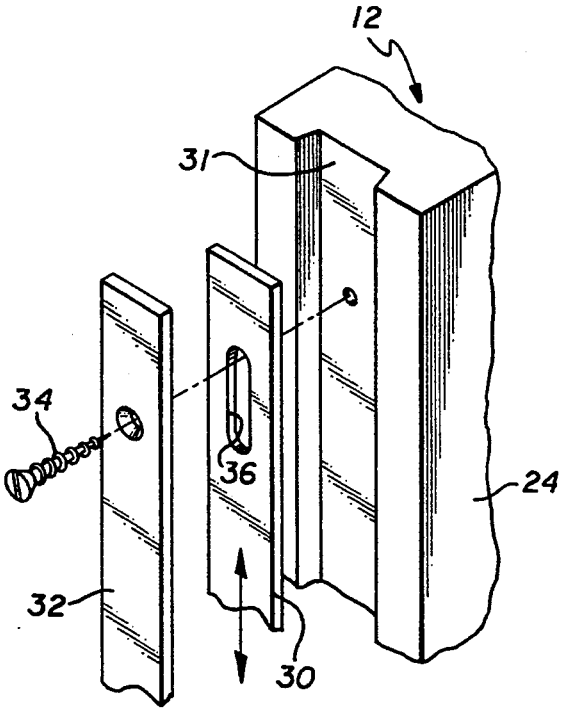
FIG. 3

FIG. 4
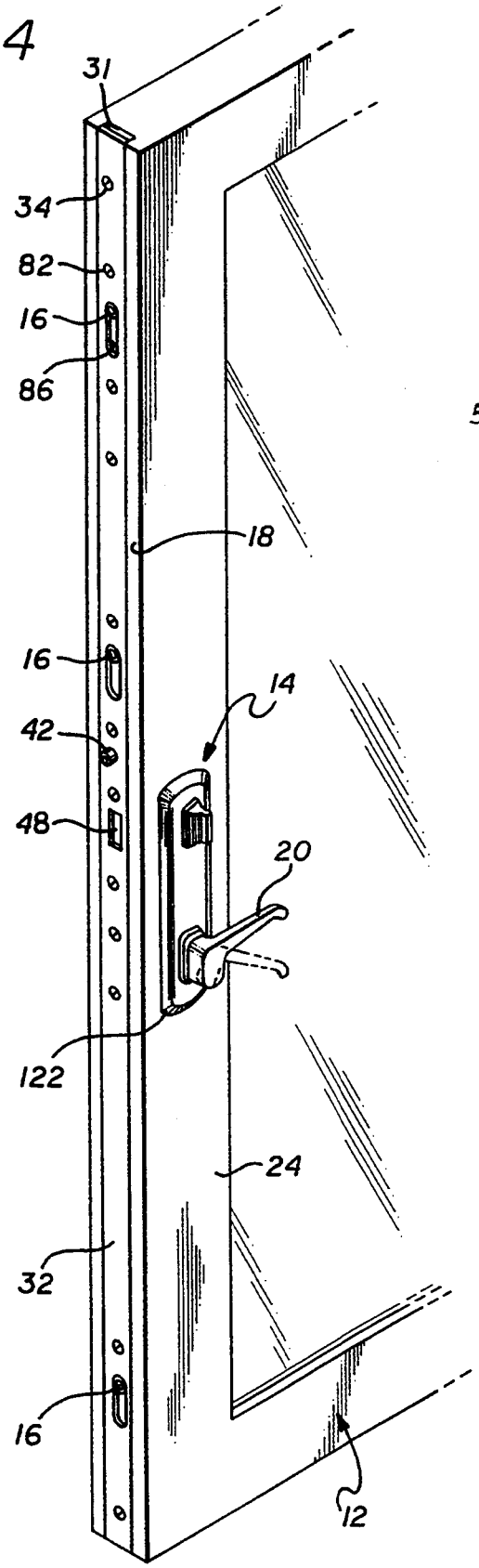
FIG. 5
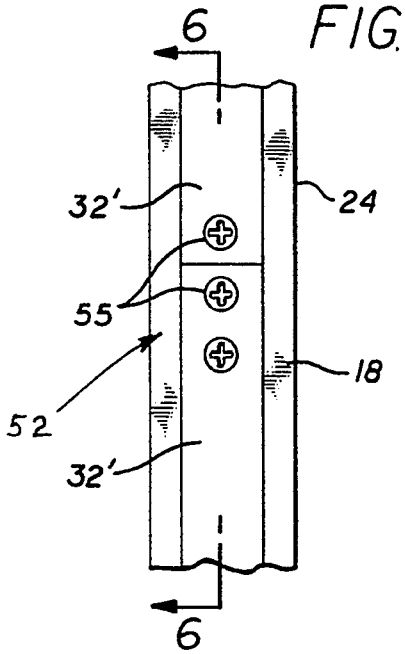
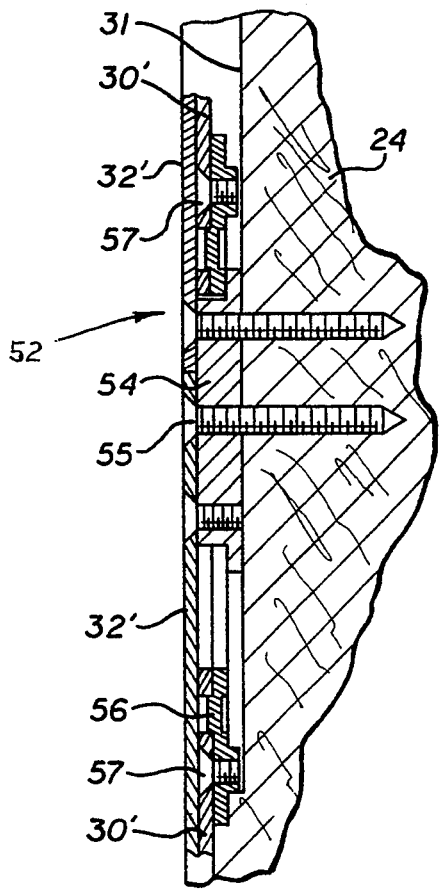
FIG. 6

84
58'
86
74
76
68
16
60
30
24
32
59
42
48
124
152
122
150
120
20
140
132
14
114

30
66
72
16
68
58'
86
74
84
60
59
42
48
124
152
120
154
150
122
132
20
140
14

165
186
164
163
128
48
157
162
169
168
120
155
154
152
150
142
134
136
20
144
30
148
140
130
138
132
32
114
116
24

MULTIPOINT LOCK ASSEMBLY FOR A SWINGING DOOR

BACKGROUND OF THE INVENTION

This invention relates generally to an improved door lock assembly designed for secure multipoint locking of a door, particularly such as an entry door for a residence or business establishment. The improved multipoint door lock assembly is designed for use with a hinged or swinging door, and includes a plurality of latch pins for securing the swinging door in a tightly closed condition. The multiple latch pins are adapted for coordinated operation from a single or main actuator, in combination with a security deadbolt and a related panic release mechanism for quickly and easily unlocking and opening the door from the inside.

Door lock assemblies for use with hinged swinging doors are generally known in the art. Such lock assemblies typically include one or more movable lock members mounted at a vertical position along a free side edge of the door in close proximity with an actuator positioned for convenient manual operation. For example, a spring-loaded latch bolt is normally mounted at a mid-height position on the door side edge to engage a strike or keeper plate on an adjacent door jamb to maintain the door in a closed and/or locked condition. A door handle or lever is normally included as part of the lock assembly and is adapted for manual rotation to retract the latch bolt and thereby permit the door to be opened. A deadbolt is frequently associated with the latch bolt for extension or retraction by means of keyed cylinder or a manually operated thumb turn or the like.

Although door lock assemblies of the general type described above have performed their latching and/or locking functions in a generally satisfactory manner, there has been a continuing desire and need for further improvements in high security lock assemblies designed to safely and positively lock a door against unauthorized entry. Toward this end, so-called multipoint lock assemblies have been proposed with multiple lock members provided along the door side edge for engaging a corresponding number of keeper plates mounted on the adjacent door jamb. In some instances, the multiple lock members are designed for independent actuation, with the unfortunate result that some of the locking members are frequently left disengaged due to human forgetfulness and/or neglect. In other designs, the multiple lock members are adapted for concurrent actuation from a single actuator lever or handle, but these systems have tended to be relatively difficult to assemble and install in a cost effective manner. Moreover, multipoint lock assemblies have typically required significant component disassembly to reconfigure the components to accommodate reversible installation on a swinging door adapted for left- or right-handed swinging movement.

The present invention provides an improved multipoint lock assembly for use with a swinging door, wherein multiple lock members are operated concurrently from a single main actuator, in coordinated operation with a security deadbolt, and wherein the components require minimal reconfiguration to accommodate reversible left- or right-handed swinging movement. The improved lock assembly is further designed to provide a tight and substantially weatherproof fit between the door side edge and an adjacent door jamb, when the door is in a closed condition.

SUMMARY OF THE INVENTION

In accordance with the invention, an improved multipoint lock assembly is provided for use with a swinging door, to retain the door in a position closed tightly against an adjacent door jamb. The multipoint lock assembly includes a actuator cartridge for operating a plurality of latch pins mounted at spaced positions along a free side edge of the swinging door. When the door is closed, the latch pins advance into engagement with ramped strike plates on the adjacent door jamb to draw and retain the door in a tightly closed condition. The actuator cartridge further includes a deadbolt which can be thrown to positively lock the door, in combination with a panic release mechanism which permits rapid unlocking and opening of the door from the inside.

More specifically, in the preferred form, the main actuator cartridge is adapted for installation into the door side edge in a position for rotatably supporting indoor and outdoor lever handles at a normal mid-height position. The actuator cartridge includes a mechanical drive linkage for displacing an elongated drive bar through a reciprocal stroke in response to manual rotation of the indoor or outdoor lever handle. The drive bar is coupled with a plurality of latch pin units mounted at vertically spaced positions along the door side edge, with each latch pin unit having a latch pin movable between an advanced position and a retracted position in response to drive bar displacement. The latch pins in the retracted position are withdrawn into the door side edge to permit door opening, whereas in the advanced position the latch pins protrude outwardly from the door side edge for reception when the door is closed into engagement with respective strike plates mounted in the adjacent door jamb.

A spring-loaded trigger assembly is operated by the drive bar to control the position of the latch pins. More particularly, upon rotation of the indoor or outdoor lever handle to displace the drive bar in a direction retracting the latch pins, a trigger key engages the drive bar to retain the latch pins in the retracted position. A trigger pin protruding outwardly from the door side edge is positioned to contact a trigger strike on the adjacent door jamb when the door is closed to disengage the trigger key from the drive bar, and thereby permit spring-loaded displacement of the drive bar toward a position advancing the latch pins. In accordance with one aspect of the invention, the latch pins engage ramped strike plates surfaces to draw the door side edge securely and tightly against the door jamb.

A deadbolt mechanism is mounted within the main actuator cartridge and includes a security deadbolt for positively locking the door in the closed position. Conventional actuator means are provided, such as an indoor thumb turn and an outdoor keyed cylinder, for displacing the deadbolt between a protruding thrown or locked position, and an unlocked position retracted into the door side edge. Interlock means are provided for preventing the deadbolt from being thrown to the locked position unless the latch pins are in the advanced position.

A panic release mechanism is coupled between the indoor lever handle and the deadbolt mechanism. In the preferred form, the panic release mechanism comprises a panic release plate which is slide-mounted into a recessed track disposed at the exterior of the actuator cartridge, wherein the panic release plate is operably connected with cam pins movable respectively with the indoor lever handle and the deadbolt actuator means. When the deadbolt is thrown, rotation of the indoor lever handle displaces the panic release plate to retract the deadbolt and also to retract the latch pins so that the door can be opened. By contrast, with the deadbolt thrown, the outdoor lever handle is uncoupled from the drive bar, whereby rotation of the outdoor lever handle is ineffective to open the deadbolted door.

In accordance with one primary aspect of the invention, the multipoint lock assembly may be installed quickly and easily at the side edge of a swinging door, with minimal component reconfiguration necessary to accommodate a left- or right-handed swinging installation. The appropriate directional installation is obtained by mounting the panic release plate on the indoor side of the main lock cartridge, in combination with appropriate orientation of the indoor thumb turn and the outdoor keyed cylinder of the deadbolt actuator means.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented indoor side elevational view depicting the free side edge of a swinging door equipped with the improved multipoint lock assembly embodying the novel features of the invention, and depicting the door in a closed and locked condition with respect to an adjacent door jamb;

FIG. 3 is an enlarged fragmented exploded perspective view of a portion of the door side edge, corresponding generally with the encircled region 3 of FIG. 2;

FIG. 4 is a fragmented perspective view of the free side edge of the swinging door depicted in FIG. 2, and illustrating the lock assembly in an unlocked condition with the door open;

FIG. 5 is an enlarged fragmented side edge elevation view of a portion of the swinging door, in an alternative configuration;

FIG. 6 is a fragmented vertical sectional view taken generally on the line 6—6 of FIG. 5;

DETAILED DESCRIPTION OF THE PREFERRED EMBODIMENT

Figure 2:
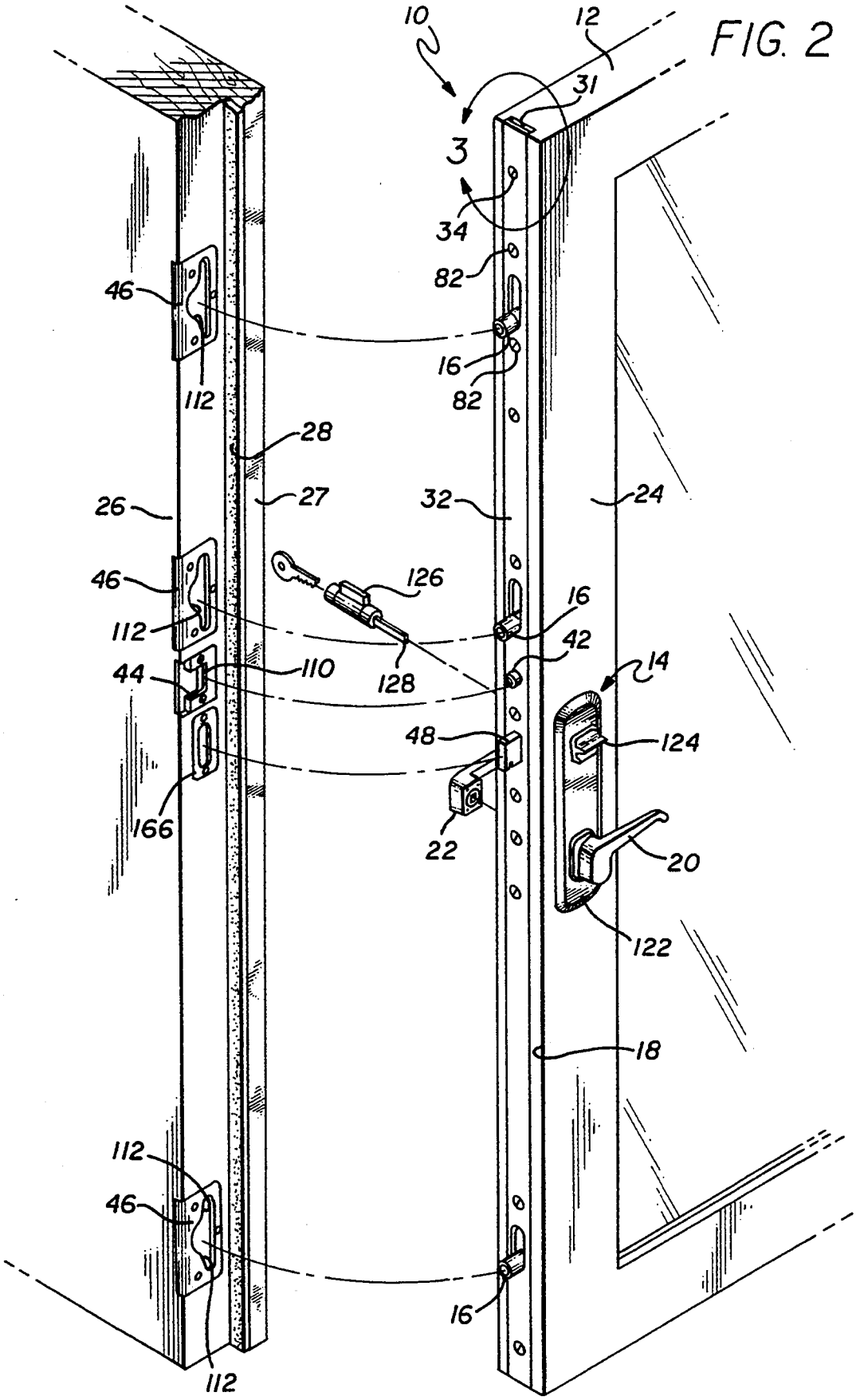
FIG. 2 is a fragmented perspective view illustrating the free side edge of the swinging door depicted in FIG. 1, in exploded relation the adjacent door jamb.

As shown in the exemplary drawings, an improved multipoint lock assembly referred to generally by the reference numeral 10 in FIG. 1 is provided for high security locking of a swinging door 12 in a tightly closed condition. The multipoint lock assembly 10 includes a single or main actuator cartridge 14 for displacing a plurality of latch pins 16 between an advanced position protruding from a free side edge 18 of the swinging door, as viewed in FIGS. 1 and 2, and a retracted position withdrawn into the door side edge as viewed in FIG. 4. Indoor and outdoor lever handles 20 and 22 (FIG. 2) are mounted on the main actuator cartridge 14 to displace the latch pins 16 between the advanced and retracted positions.

The multipoint lock assembly 10 of the present invention provides multiple latch points at vertically spaced positions along the free side edge 18 of the swinging door 12. In this regard, the main actuator cartridge 14 and associated drive mechanisms for operating the latch pins 16 are installed within the free side edge of the door, such as within a vertical stile 24, at a position generally opposite to hinge mechanisms (not shown) used to support the door from a door jamb or frame 26 for normal swinging movement between open and closed positions. The multiple latch points provided by the plurality of latch pins 16 result in increased security when the door is closed and locked. In addition, the latch pins 16 are designed to draw the door side edge 18 into tightly closed relation with a stop strip 27 (FIG. 2) of the door jamb 26, thereby preventing unsightly gaps, inadequate engagement with weatherstripping 28, and/or ineffective locking of the door attributable to slight warping or bowing of the door shape. Importantly, the multipoint lock assembly 10 of the present invention can be adapted quickly and easily, with minimum component reconfiguration, to accommodate installation into the door side edge for either left- or right-handed swinging movement of the door.

In general terms, as shown in FIGS. 1–4, the multipoint lock assembly 10 provides for coordinated and concurrent operation of the latch pins 16, with the illustrative drawings showing three of said latch pins mounted generally at upper, lower, and mid-height positions, respectively, at the door side edge 18. The latch pins 16 are mechanically coupled with the main actuator cartridge 14 by means of an elongated strip-shaped, and relatively rigid drive bar 30 mounted for reciprocal sliding movement within a recessed channel 31 (FIG. 3) formed in the exposed or free side edge 18 of the door 12. A face or trim plate 32 is also mounted within the channel 30 to overlie the drive bar 30, with appropriate mounting screws 34 passed through the face plate 32 and further through vertically elongated slots 36 in the drive bar 30 for fastened connection into the door edge. The drive bar slots 36 (FIG. 3) accommodate vertical reciprocation of the drive bar 30 within the channel 31, in a position underlying the face plate 32, to advance and retract the latch pins 16, as will be described.

Rotation of the indoor or outdoor lever handles 20 or 22 slides the drive bar 30 upwardly within the channel 31 to retract the latch pins 16 to positions withdrawn into the door side edge, as viewed in FIG. 4. Drive springs 38 (FIGS. 11–13) apply a substantial spring force to the drive bar 30, for urging downward drive bar displacement to return the latch pins 16 to the advanced position. A trigger assembly 40 (FIGS. 17–20) is cocked for temporarily retaining the latch pins 16 in the retracted position, despite the spring force applied by the drive springs 38. A trigger pin 42 of the trigger assembly 40 engages a trigger strike 44 on the door jamb 26, upon closure of the door, to trip the trigger assembly 40 and permit the drive springs 38 to return the latch pins 16 to the advanced position. In the advanced position, as viewed in FIG. 2, the latch pins project into engagement with strike plates 46 on the adjacent door jamb to retain the door in the tightly closed condition.

Figure 26:
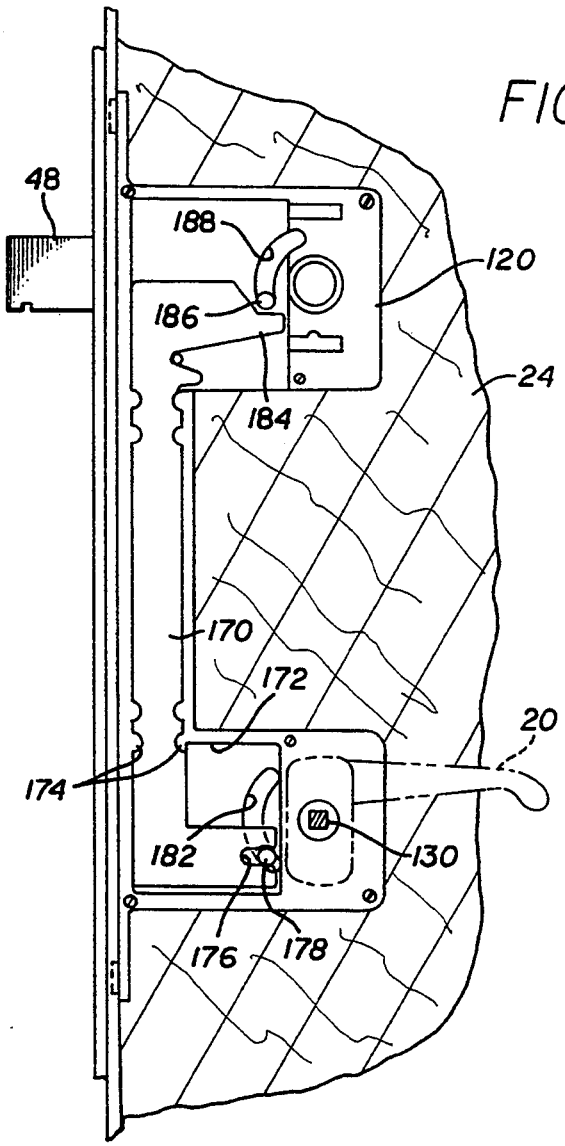
FIG. 26 is a fragmented vertical section of the main lock cartridge, and illustrating the panic release plate mounted thereon in a normal position when the deadbolt is thrown.
Figure 27:
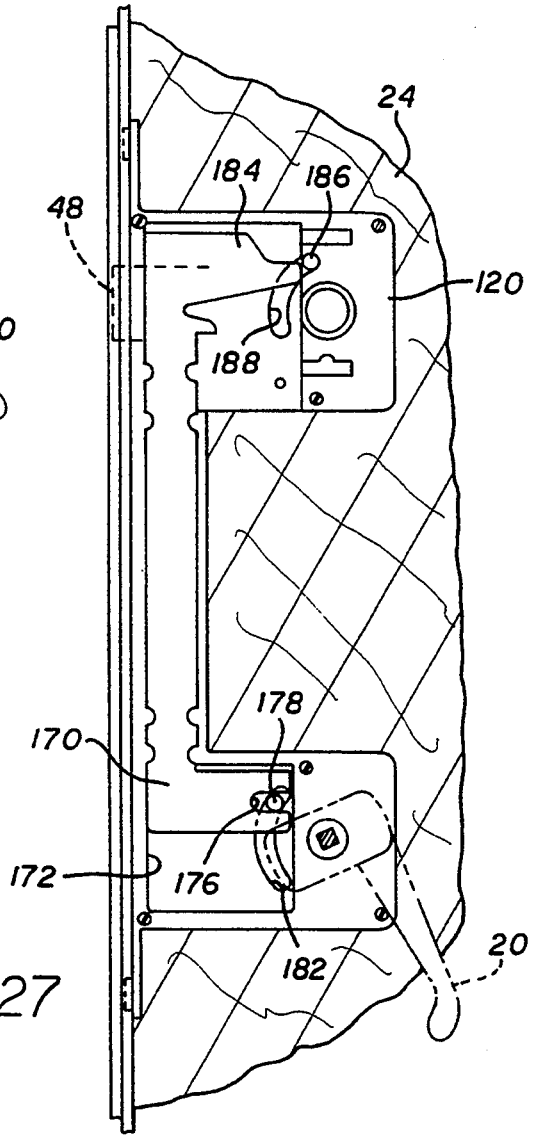
FIG. 27 is a fragmented vertical section similar to FIG. 26 and illustrating the panic release plate shifted to retract the deadbolt upon movement of the indoor lever handle.

In accordance with further general operation of the multipoint lock assembly 10, a security deadbolt 48 is mounted within the main actuator cartridge 14 for use in positively locking the door. Interlock means are provided for preventing the deadbolt from being thrown to a locked position unless the latch pins 16 are in the advanced position to thus indicate that the door is closed. Moreover, when the door is closed and the deadbolt 48 is thrown, a panic release mechanism 50 (FIGS. 25–27) permits panic retraction of the deadbolt as well as the latch pins 16 upon rotation of the indoor lever handle 20. However, when the deadbolt is thrown, the outdoor lever handle 22 is uncoupled from the lock components such that rotation of the outdoor lever handle 22 is ineffective to unlock or open the door.

In the preferred form, the drive bar 30 has an elongated one-piece construction to extend within the channel 31 in the door side edge 18 between the uppermost and lowermost latch pins 16. FIGS. 5 and 6 illustrate an alternative construction wherein the drive bar 30 can be provided in the form of multiple segments 30' interconnected end-to-end within the channel 30 by connector units 52. These connector units 52 also permit the face plate to be provided in similar segments 32' mounted end-to-end within the channel 31. The connector unit 52 comprises an anchor member 54 fastened securely to the door side edge by means of elongated screws 55 which extend through appropriate apertures in the adjacent ends of the face plate segments 32'. The anchor member 54 defines a fixed shuttle guide for a slide link 56 carried on the anchor member 54 for vertical reciprocation, with opposite ends of the slide link 56 connected by smaller screws 57 to adjacent ends of the drive bar segments 30'.

Figures 7, 8:
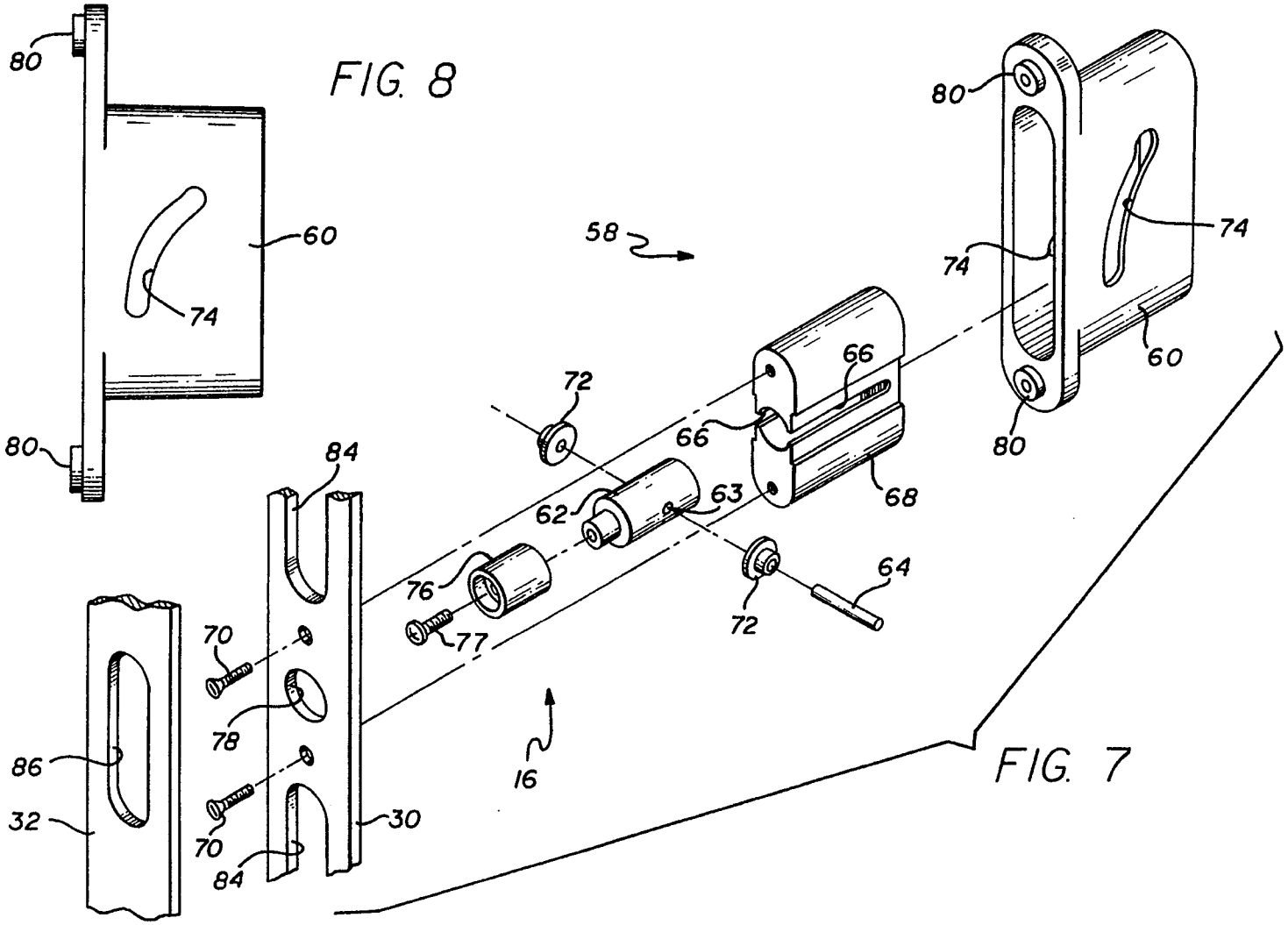
FIG. 7 is an exploded fragmented perspective view illustrating a latch pin unit forming a portion of the multipoint lock assembly.
FIG. 8 is a side elevational view of a latch pin case forming a portion of the latch pin unit shown in FIG. 7.

The latch pins 16 are each installed within a latch pin unit which includes means for supporting the associated latch pin 16 for movement between the advanced and retracted positions, in response to vertical reciprocation of the drive bar 30. FIG. 7 and 8 show the uppermost latch pin unit 58 to include a hollow latch case 60. Modified latch pin units 58' are provided for the remaining two latch pins at the mid-height and lowermost positions, with the latch pin units 58' differing only by inclusion of an extended lower case 59 for selected mounting of the drive springs 38 or the trigger assembly 40, as will be described.

With reference to FIGS. 7 and 8, each latch pin 16 comprises a cylindrical plunger 62 having a transverse cross bore 63 for receiving a bearing cross shaft 64. The cross shaft 64 has opposite ends protruding laterally outwardly from the cylindrical plunger 62, for passage through elongated slots 66 extending in a fore-aft direction in the opposite side walls of a slide carrier 68. The slide carrier 68 has a front face mounted securely by screws 70 or the like to the drive bar 30. The slide carrier 68 is received in turn within the associated latch case 60, with guide rollers 72 on the cross shaft 64 being carried within angled cam slots 74 formed in the opposite side walls of the latch case 60. A cylindrical roller head 76 is mounted by a screw 77 onto a forward or tip end of the plunger 62, and normally protrudes into and/or through a circular port 78 in the drive bar 30. Upper and lower mounting bosses 80 on the latch case 60 permit secure attachment of the latch case 60 to the face plate 32 by appropriate passage of mounting screws 82 (FIGS. 2 and 4) extending through vertically elongated slots 84 in the drive bar 30 (FIG. 7).

With this construction, upward displacement of the drive bar 30 and the slide carrier 68 attached thereto displaces the latch pin 16 through a similar upward stroke. This upward stroke motion of the latch pin is permitted by a latch pin slot 86 in the face plate 32. Importantly, the cam slots 74 in the latch case 60 are shaped to extend upwardly and rearwardly away from the drive bar 30, such that upward latch pin 16 displacement is accompanied by latch pin retraction. Conversely, downward motion of the drive bar 30 carries the latch pin 16 through a similar downward stroke, with the cam slots 74 causing the latch pin to move from the retracted position to the advanced position.

Figure 9:
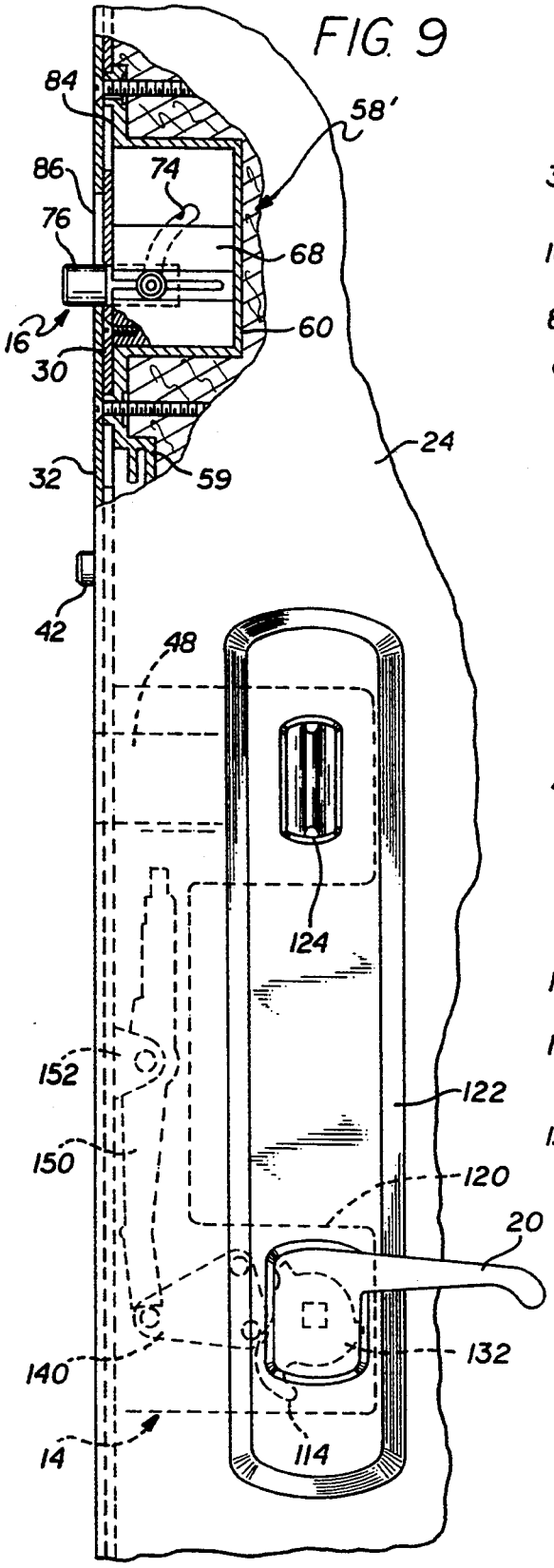
FIG. 9 is an enlarged fragmented indoor side elevational view depicting a main actuator cartridge in operative association with one of a plurality of latch pin units, and showing a latch pin in an advanced position protruding from the door side edge.
Figure 10:
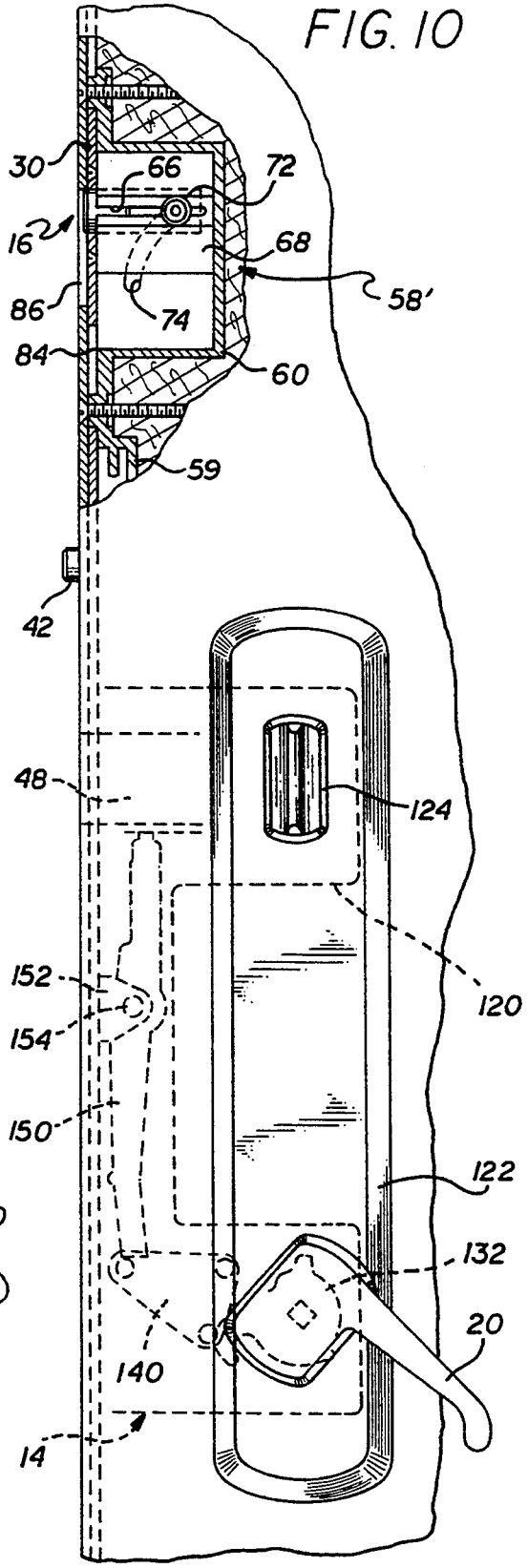
FIG. 10 is an enlarged fragmented indoor side elevational view similar to FIG. 9, but depicting the latch pin in a retracted position withdrawn into the door side edge.

FIGS. 9 and 10 depict the latch pin 16 mounted within the modified latch pin unit 58' disposed at the mid-height position at the door side edge 18. FIG. 9 illustrates the latch pin 16 drawn downward by the drive bar 30, to the advanced position with the roller head 76 protruding from the door side edge. FIG. 10 illustrates the drive bar 30 shifting the latch pin the upper position, with the cam slots 74 in the associated case 60 causing the latch pin to be withdrawn to the retracted position concealed within the door side edge. A similar movement of all three latch pins 16 occurs in response to vertical reciprocation of the drive bar 30.

Figure 11:
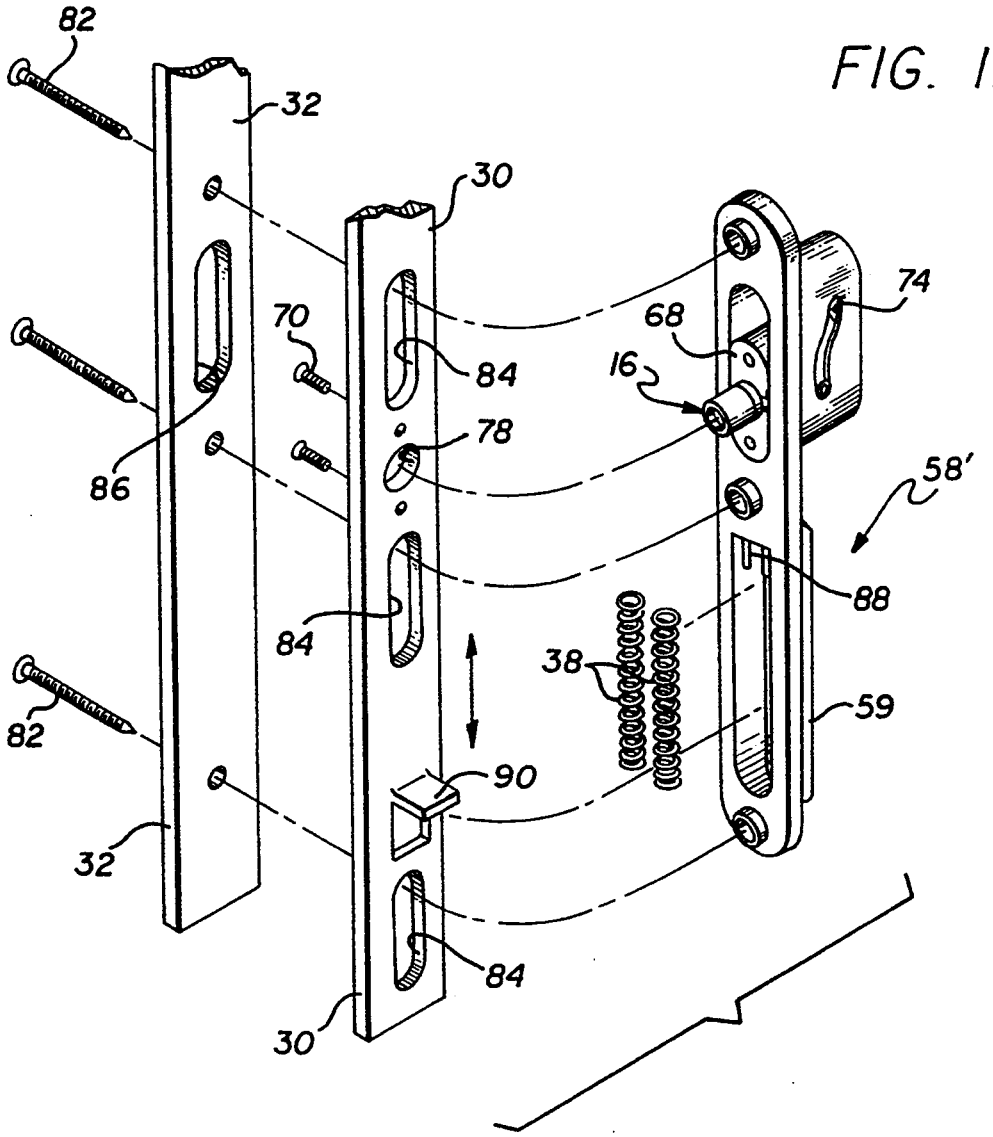
FIG. 11 is a fragmented exploded perspective view illustrating a latch pin unit in combination with means for spring loading of the latch pins.
Figure 12:
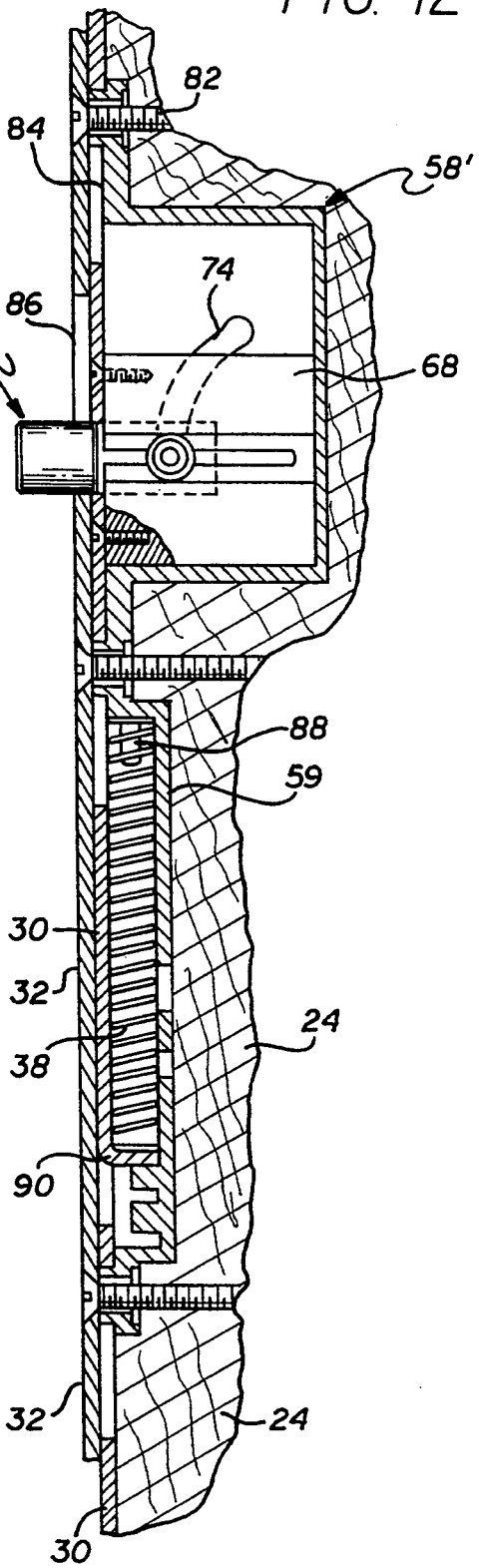
FIG. 12 is a enlarged fragmented indoor side elevational view depicting the latch pin unit of FIG. 11, and showing a latch pin protruding outwardly from the door side edge.
Figure 13:
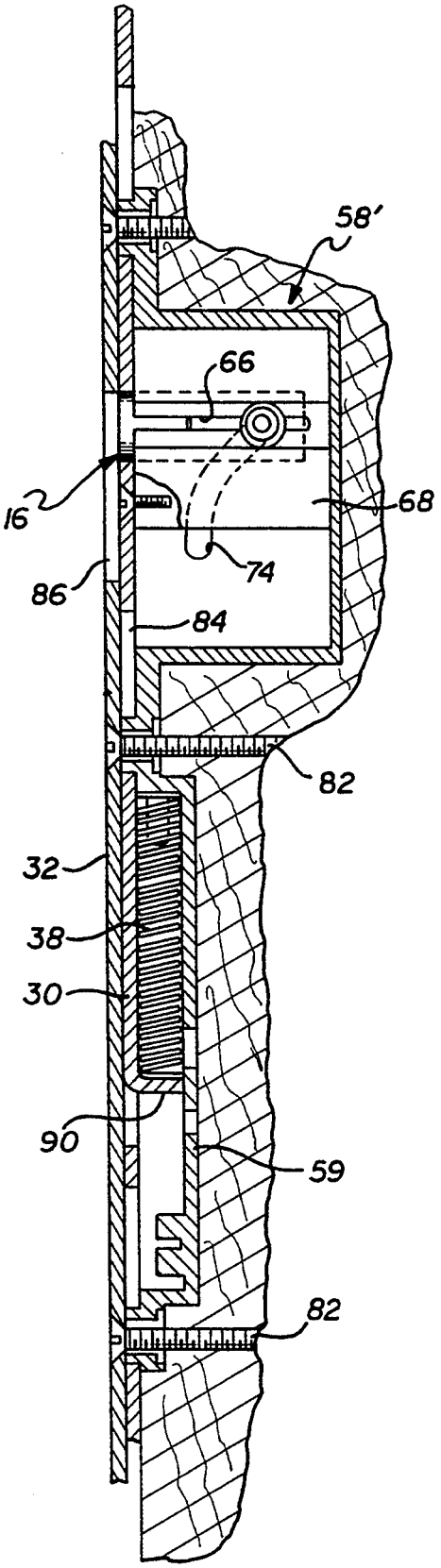
FIG. 13 is an enlarged fragmented vertical sectional view depicting the latch pin unit of FIG. 12, and showing the latch pin withdrawn to the retracted position.

FIGS. 11-13 illustrate the latch pin unit 58' associated with the latch pin 16 at the lowermost position along the door side edge, wherein this latch pin unit 58' includes the drive springs 38 mounted within the lower extended portion 59 of the latch case. As shown, one or more compression springs 38 are mounted within the lower portion 59 of the latch case, with upper ends of the springs seated over mounting posts 88. The lower ends of the drive springs 38 engage a tab 90 which may be struck inwardly from the drive bar 30 to project into the lower portion 59 of the latch case. As shown in FIG. 12, when the latch pins 16 are in the advanced position, the drive springs 38 are disposed in a nearly fully extended position to apply a relatively small downward spring force to the drive bar 30. When the main actuator cartridge 14 is operated to raise the drive bar 30, for purposes of retracting the latch pins 16 as viewed in FIG. 13, the drive springs 38 are compressed by upward displacement of the drive bar tab 90. As a result, when the latch pins 16 are retracted, a substantial downward spring force is applied to the drive bar 30, for spring-loaded return of the drive bar 30 to the lowered position with the latch pins advanced.

FIGS. 17-20 illustrate the trigger assembly 40 installed into the lower portion 59 of the latch case of the modified latch pin unit 58' at the mid-height position on the door. As shown, the trigger assembly 40 comprises a trigger key 92 mounted within the latch case by a pivot screw 94 for back-and-forth pivoting motion in a plane generally parallel to the adjacent drive bar 30. A centering spring 96 mounted within the latch case on associated posts 98 has a pair of spring legs engaging opposite sides of a foot 100 on the trigger key 92, for purposes of maintaining a pie-shaped trigger land 102 in a generally centered position.

A relatively narrow width trigger stop 104 is formed on the inboard side of the drive bar 30 to project into engagement with the trigger land 102. When the latch pins 16 are in the advanced position, the trigger stop 104 is positioned at one side of the trigger land 102, as viewed in FIGS. 17 and 18. However, with the latch pins are retracted, the trigger stop 104 slides upwardly past the pie-shaped land 102 to a position immediately above the upper end of the trigger land. In this position, the centering spring 96 centers the land 102 beneath the stop 104, such that the trigger land 102 prevents downward movement of the drive bar 30 in response to the spring action of the drive springs 38.

The trigger pin 42 is mounted on the trigger land 102 at a position above the pivot screw 94, and protrudes outwardly from the door side edge through an elongated slot 107 in the drive bar 30, and an aligned opening 108 in the face plate 32. The size and position of the trigger pin 42 causes the pin to engage an edge surface 110 on the trigger strike 44 (FIG. 2) when the door is closed, resulting in lateral displacement of the trigger pin 42 sufficient to permit downward return movement of the trigger stop 104 with the spring-loaded drive bar 30. Thus, when the door is closed, the trigger pin 42 contacts the strike edge 110 to trip the trigger assembly 40, and permit the drive springs 38 to return the drive bar 30 to the lower position. This downward drive bar motion is a accompanied by rapid advancement of the latch pins 16 from the retracted to the advanced positions for retaining the door in a tightly closed condition.

More particularly, as shown best in FIG. 2, each latch pin 16 is adapted to engage a strike plate 46 in the adjacent door jamb, when said latch pins are in the advanced position. Each strike plate 46 has a generally triangular shaped central opening with a base leg disposed at the outdoor side of the strike plate in generally parallel relation with the stop strip 27. An apex of the strike plate opening for each strike plate is vertically aligned with the associated latch pin 16 in the retracted position. The legs of the triangular strike plate opening extending from the apex define ramped edges 112 for engagement by the roller head 76 of the associated latch pin 16, as the latch pin is moved downwardly from the retracted position (FIG. 4) to the advanced position (FIG. 2). Accordingly, during such downward and advancing motion, the latch pin roller head 76 engages the lower one of the two ramped edges 112 to draw the door side edge 18 securely and tightly against the stop strip 27. Conveniently, the provision of the upper and lower ramped edges 112 on each strike plate 46 permit fully reversible installation of the strike plate into the door jamb 26, to accommodate left- or right-handed closure movement of the door.

The combination of the three latch pins 16 engaging the ramped edges 112 of the three associated strike plates 46 at vertically spaced positions causes the door side edge 18 to be drawn tightly and securely to the closed condition, at multiple latch points spaced vertically along the door. This multiple tight latching arrangement provides positive closure with high security latching, notwithstanding door bow or warp which can occur as a result of exposure to temperature differentials, or from exposure to inclement weather over a prolonged period of use. The tight fitting engagement between the door side edge 18 and the jamb 26 at multiple vertical positions prevents any significant gaps between the closed door edge and the weatherstripping 28, thereby preventing undesired air leakage and/or related energy losses.

FIGS. 9, 10 and 14-16 illustrate the main actuator cartridge 14 for operating the drive bar 30. As shown, the actuator cartridge 14 has a size and shape for secure mounting into an appropriately shaped pocket formed in the free side edge 18 of the door 12, generally at a mid-height position adapted for standard-height mounting of the indoor and outdoor lever handles 20 and 22. The cartridge 14 comprises a housing 120 for rotatably supporting the lever handles 20, 22, in association with conventional exterior trim escutcheon hardware 122. The security deadbolt 48 is mounted in an upper portion of the cartridge housing 120 for movement between a thrown or locked position and a retracted position, in response to operation of standard deadbolt actuating devices, such as a thumb turn 124 mounted on the indoor side of the door, and a keyed cylinder 126 (FIG. 2) mounted on the outdoor side of the door. As is known in the art, the thumb turn 124 and keyed cylinder 126 may be reversibly installed in accordance with the left- or right-handed direction of door swinging movement, and operate via a common tailpiece 128 to throw or retract the deadbolt 48. The thumb turn 124 desirably has an elongated shape for easy manual grasping, and is conveniently oriented to provide a visible indication of deadbolt position. Moreover, the vertical spacing between the lever handles 20, 22 and the deadbolt actuating devices 124, 126 conveniently permits the use of standard escutcheon hardware 122 of the type used in a typical door latch and deadbolt geometry, for example, as depicted in U.S. Pat. No. 4,671,089.

Each of the indoor and outdoor lever handles 20, 22 includes a noncircular drive shaft such as the illustrative square drive shaft 130 (FIGS. 14 and 16) for rotating a respective contoured drive cam 132 mounted within the actuator housing 120. The drive cams 132 are independently rotatable in response to lever handle rotation. A radially projecting stop lobe 134 on each drive cam 132 is positioned to engage a return spring 136 when the associated handle is rotated, to obtain spring-loaded handle return to a normal, nonoperational and typically horizontal position. Additional return spring mechanisms may be incorporated into the escutcheon hardware as shown, for example, in U.S. Pat. No. 4,671,089, which is incorporated by reference herein. A return stop 114 may also be provided on the drive cam 132 to engage a stop pin 116 on the housing 120 when the lever handle is returned to the horizontal position.

Each drive cam 132 additionally includes a contoured drive lobe 138 for bearing engagement with a drive linkage connected to the drive bar 30. As shown in FIGS. 9, 10 and 14–16, this drive linkage comprises a generally triangular crank link 140 comprising a pair of triangular plates 141 (FIG. 15) connected in overlying spaced relation by a plurality of spacer pins. The crank link 140 is mounted within the cartridge housing 120 by a pivot spacer pin 142 at one corner, with a biasing spring 144 urging a follower cam spacer pin 146 at another corner into bearing engagement with the drive lobes 138 of the two handle-operated drive cams 132. With the deadbolt in a retracted position as shown, rotation of either lever handle 20, 22, displaces the associated drive lobe 138 against the follower cam pin 146 to pivot the crank link 140 in a direction lifting an output pin 148 at a forward or nose end of the crank link.

The output pin 148 at the forward end of the crank link 140 is positioned to contact the lower end of an elongated rocker arm 150 mounted centrally by a bracket 152 and pivot pin 154 to the drive bar 30. A set spring 155 reacts between the drive bar 30 and a portion of the rocker arm 150 for biasing the rocker arm toward a position for normal lifting contact by the output pin 148. Accordingly, rotation of the appropriate lever handle 20, 22, lifts the rocker arm 150 and the drive bar 30 connected therewith, to raise the drive bar in a manner retracting the latch pins 16 and cocking the trigger assembly 40, as previously described. With the latch pins retracted, the door may be opened. Reclosure of the door trips the trigger assembly 40, as previously described, resulting in spring-loaded advancement of the latch pins 16 concurrently upon door closure, with a corresponding downward shifting of the rocker arm 150 within the actuator housing 120. Downward rocker arm motion is accompanied by downward displacement of the drive bar 30 as the latch pins 16 engage the associated strike plates 46 for tight door closure.

Figure 16:
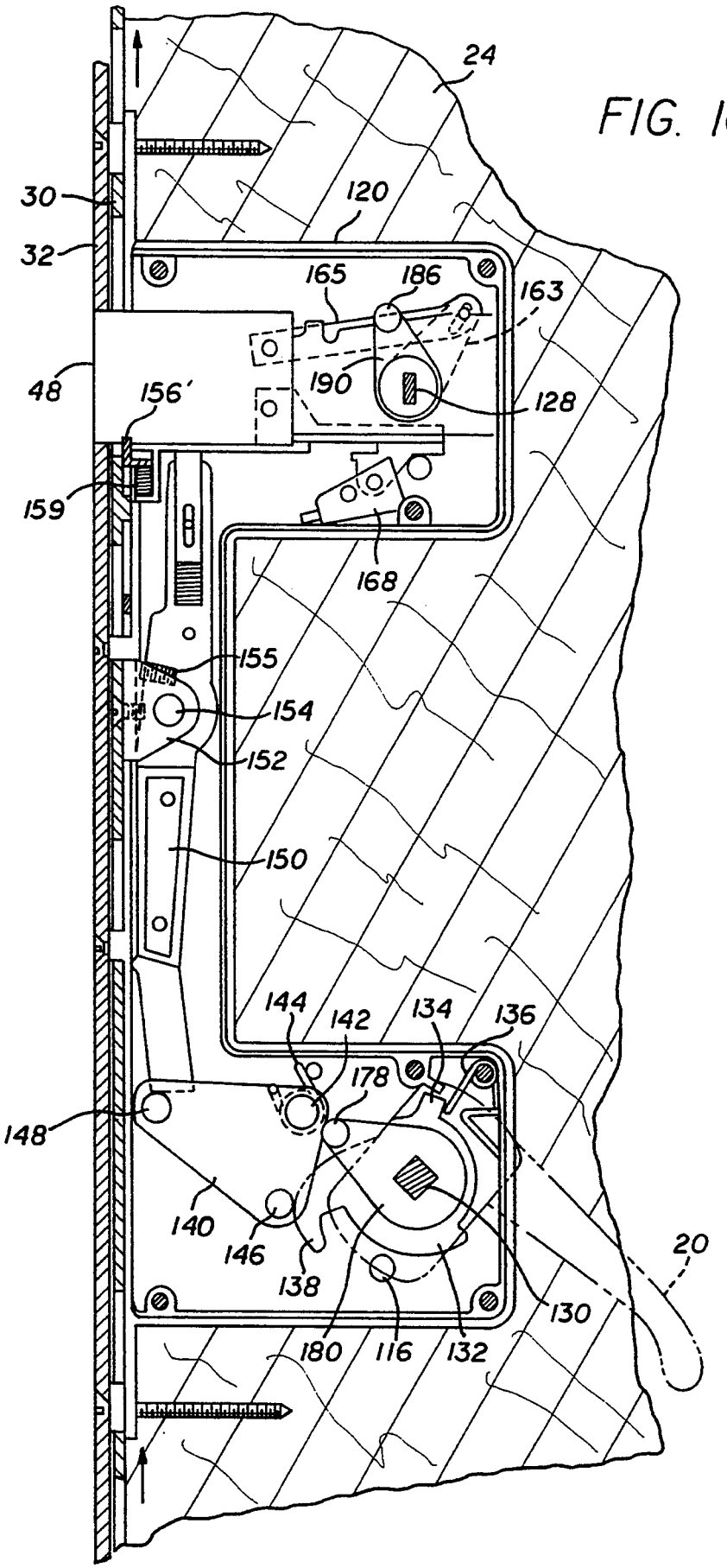
FIG. 16 is an enlarged fragmented vertical sectional view similar to FIG. 14, and illustrating the drive linkage within the main actuator cartridge in a position for retracting the latch pins.
Figure 17:
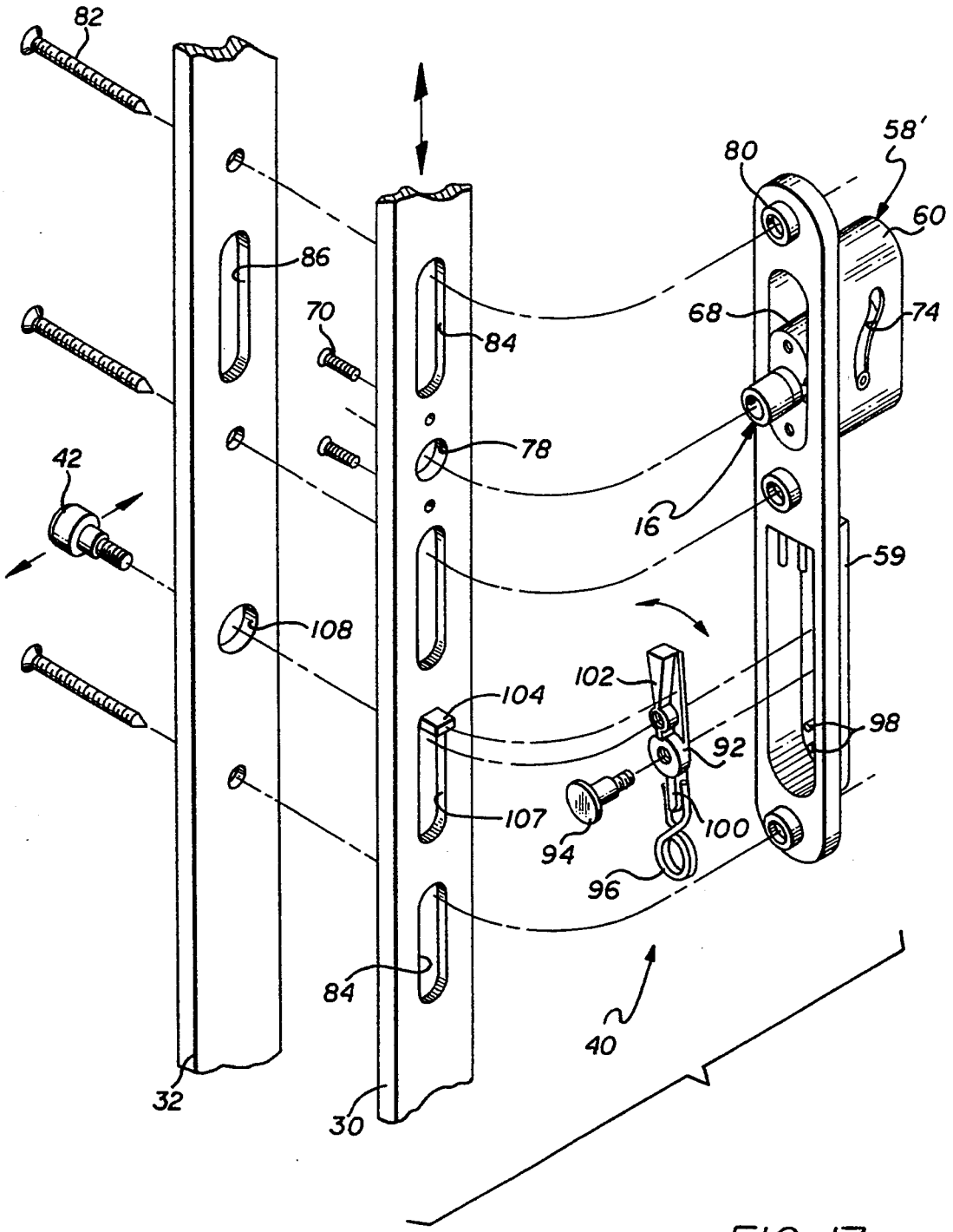
FIG. 17 is an enlarged fragmented exploded perspective view illustrating one of the latch pin units in combination with trigger means for controlling latch pin position in response to opening and closure movement of the door.
Figure 18:
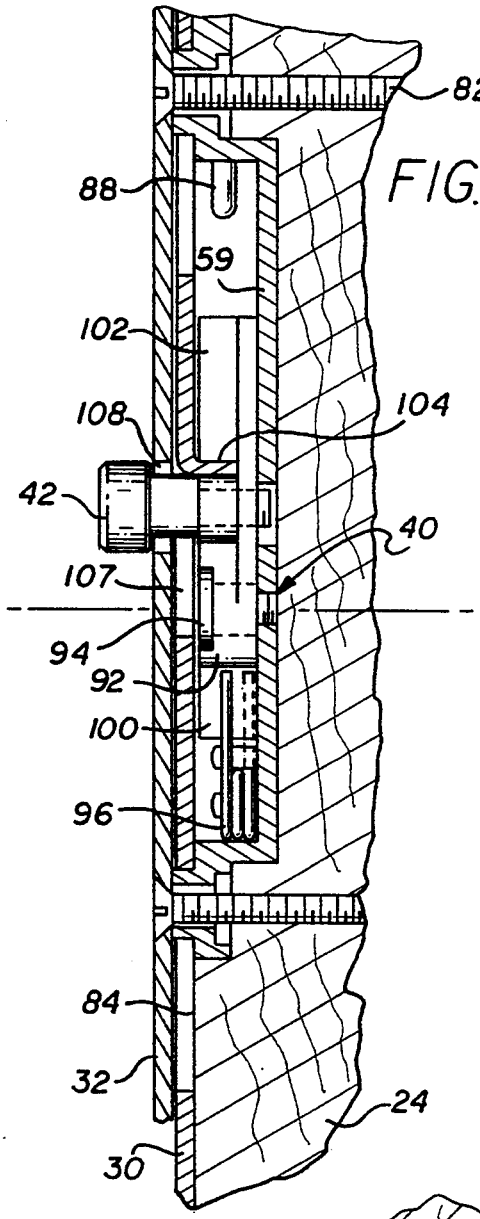
FIG. 18 is an enlarged fragmented vertical sectional view of the latch pin unit depicted in FIG. 17, and illustrating the trigger means in a normal deactivated or tripped position.
Figure 19:
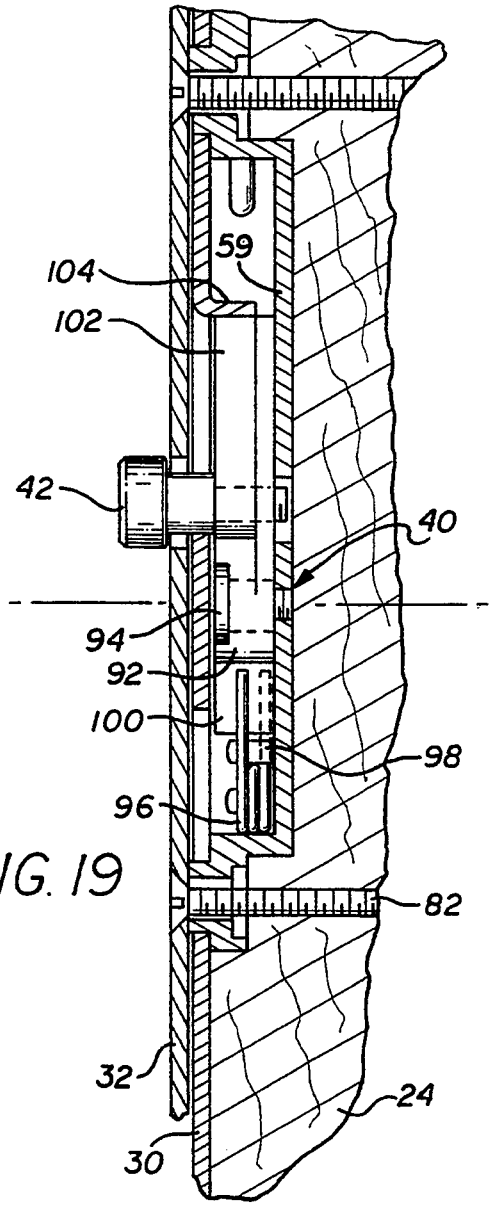
FIG. 19 is an enlarged fragmented vertical sectional view similar to FIG. 18, and illustrating the trigger assembly in a cocked position.
Figure 20:
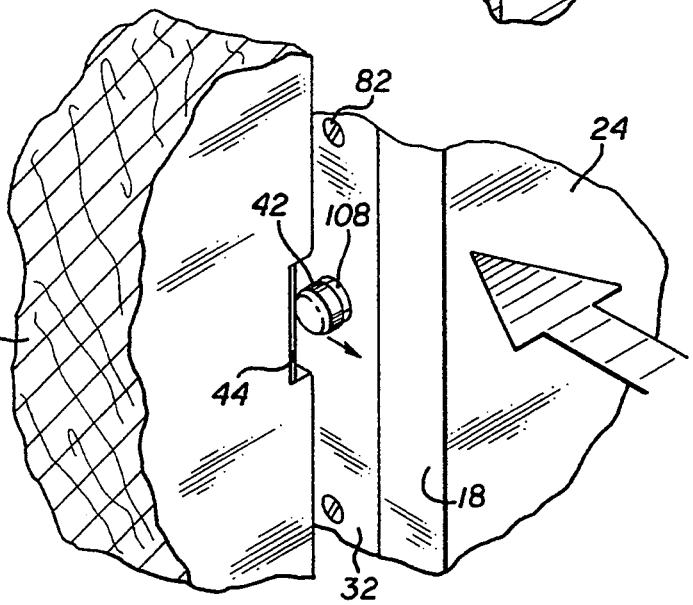
FIG. 20 is a fragmented perspective view illustrating components of the trigger means upon movement of the door to a closed position.
Figure 21:
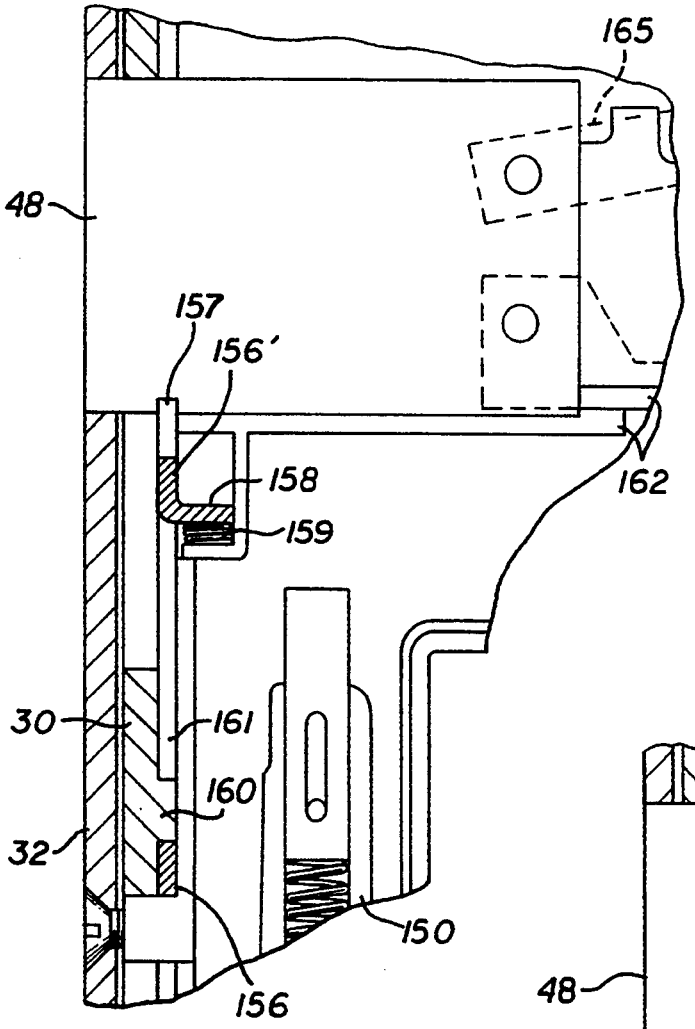
FIG. 21 is an enlarged fragmented vertical sectional view depicting a portion of the main actuator cartridge, and illustrating a latch clip retracted from a security deadbolt to permit deadbolt displacement between thrown and unlocked positions.
Figure 22:
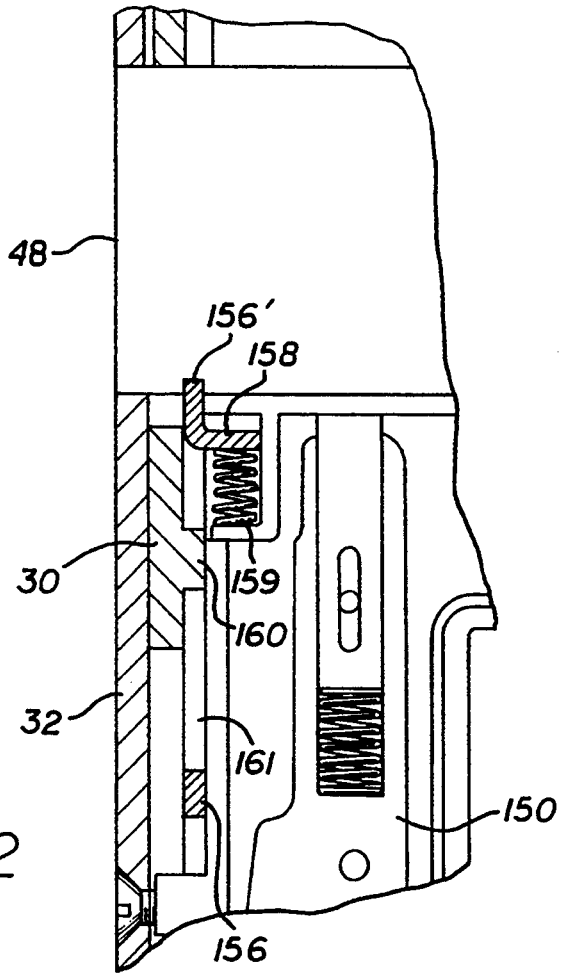
FIG. 22 is a fragmented vertical sectional view similar to FIG. 21, and illustrating interlock engagement of the latch clip with the deadbolt to prevent deadbolt displacement to the thrown position.

FIGS. 16, 21 and 22 show a latch clip 156 for preventing movement of the deadbolt 48 to the thrown position, unless the latch pins 16 are advanced, i.e., the door is closed. The latch clip 156 is mounted within the housing 120 of the main actuator cartridge 14, and has an upper end 156' for reception into a detent notch 157 in the deadbolt 48. A spring tab 158 on the latch clip 156 is engaged by a spring 159 reacting against a portion of the cartridge housing 120 for normally biasing the latch clip 156 into interlock engagement with the deadbolt 48.

The latch clip 156 is operated by a key 160 on the drive bar 30 which fits into a keyway 161 on the latch clip 156. When the drive bar 30 is lifted to retract the latch pins 16, the key 160 rides freely in the keyway 161 to permit spring-loaded movement of the latch clip upper end 156' into the deadbolt notch 157 (FIG. 22). As a result of this interlock, the deadbolt cannot be thrown to the locked position when the latch pins 16 are retracted. This arrangement prevents the deadbolt from being thrown with the door open, and thereby also prevents possible damage to the door jamb trim upon attempted door closure with the deadbolt thrown. However, when the latch pins 16 are advanced upon door closure, the drive bar key 160 engages the latch clip 156 at the lower end of the keyway 161 (FIG. 21) to retract the clip 156 from the deadbolt notch 157.

Figure 14:
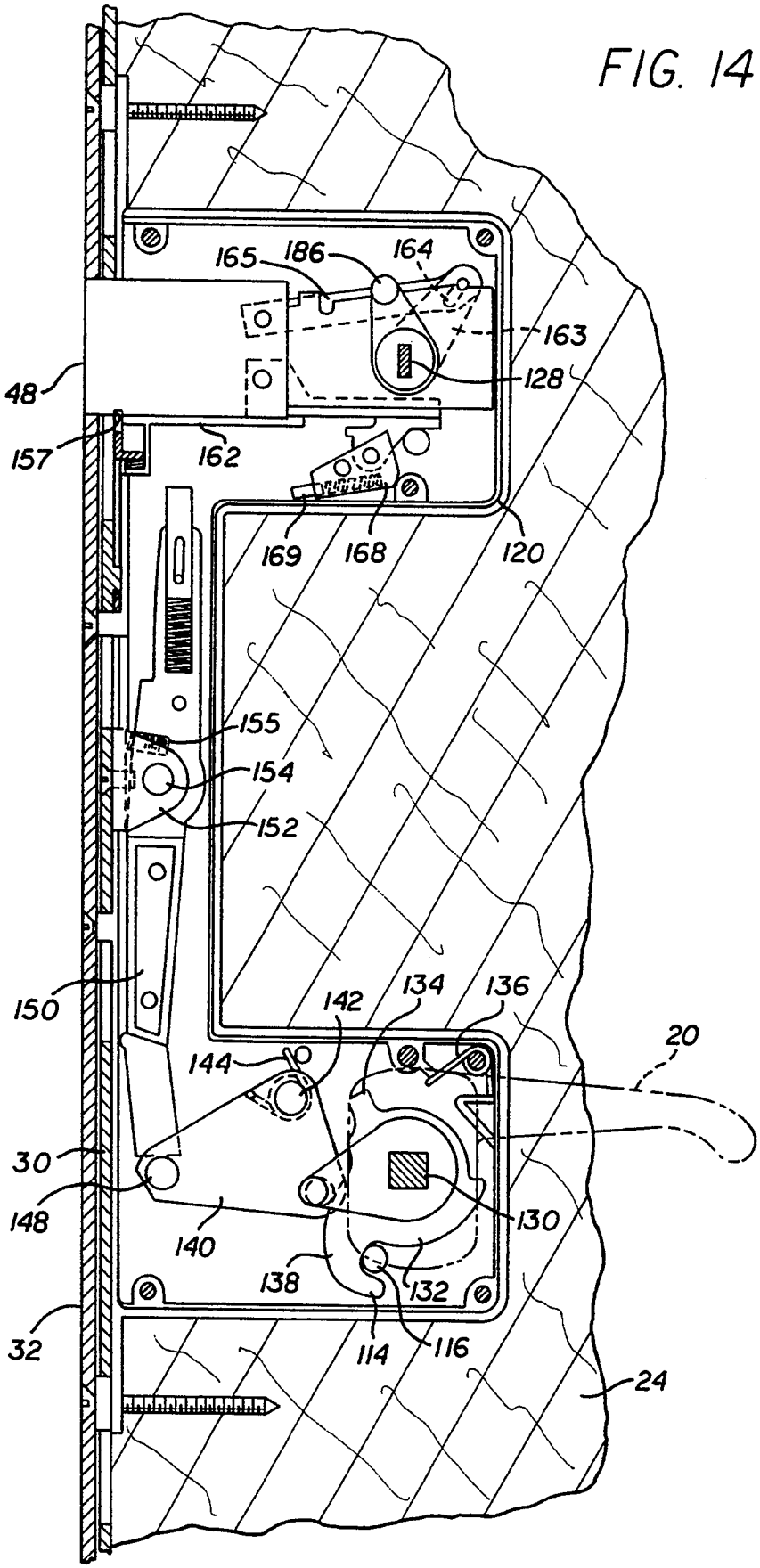
FIG. 14 is an enlarged fragmented vertical sectional view illustrating the main actuator cartridge installed within the door side edge.
Figure 15:
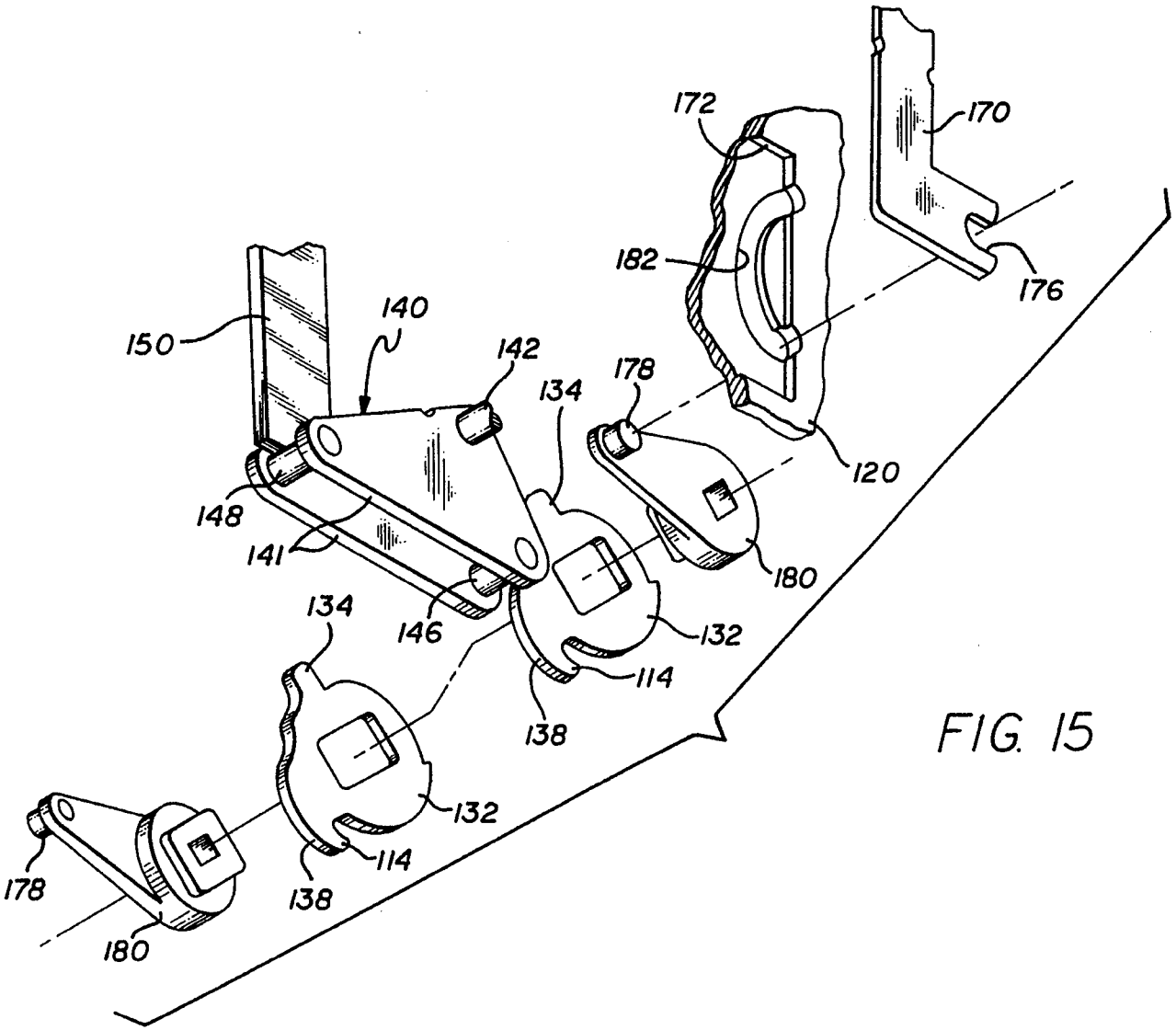
FIG. 15 is a fragmented and exploded perspective view illustrating a portion of a drive linkage mounted within the main actuator cartridge.
Figure 23:
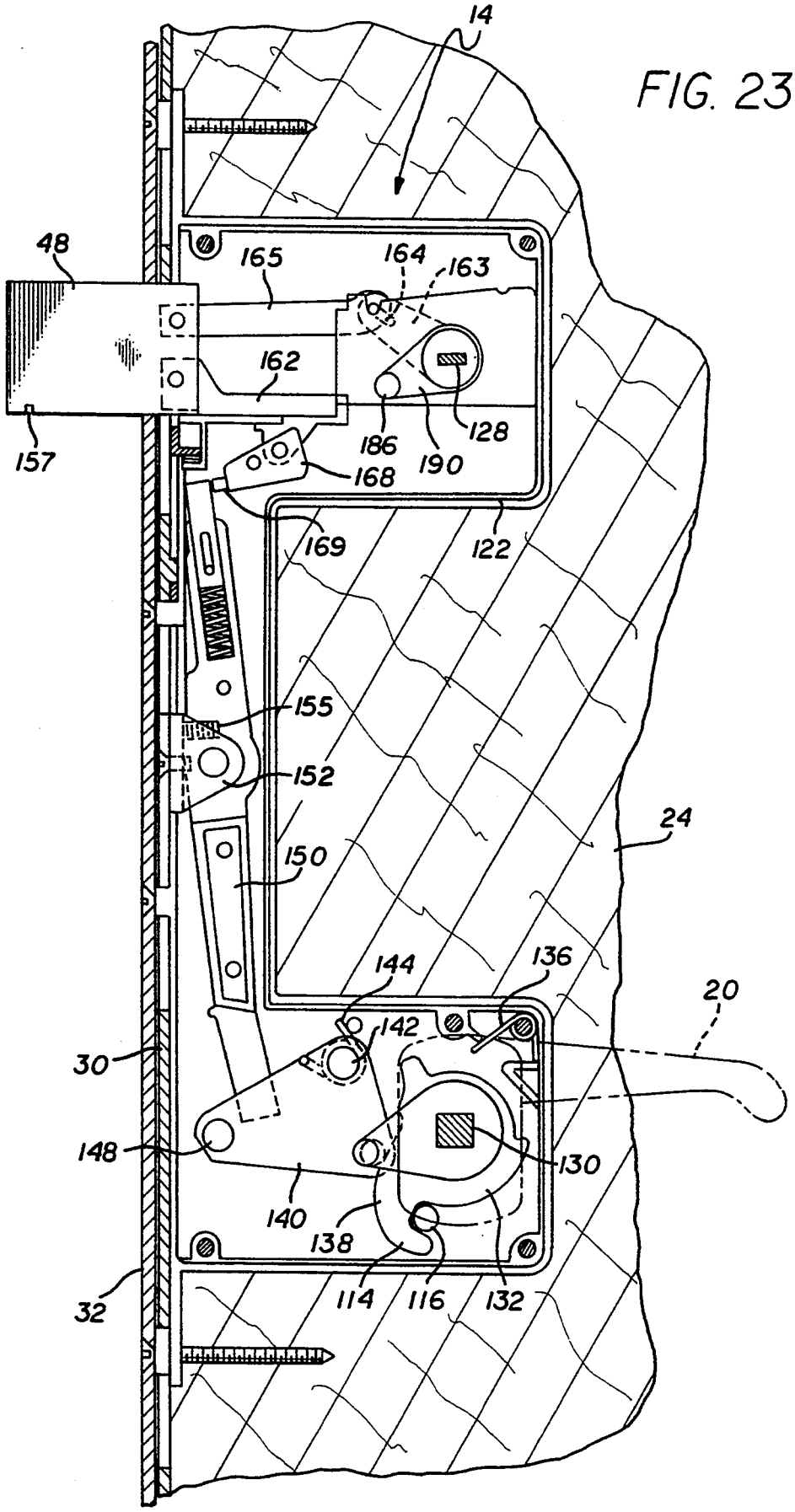
FIG. 23 is a fragmented vertical sectional view similar to FIGS. 14 and 16, and illustrating the deadbolt in a thrown position.

The deadbolt 48 is carried within the actuator housing 120 along a fixed guide track 162 for movement between the thrown and retracted positions, as shown best in FIGS. 14 and 23. That is, with the drive bar 30 shifted downwardly to advance the latch pins 16, rotation of the thumb turn 124 or the keyed cylinder 126 is effective to rotate the tailpiece 128 within the main actuator cartridge 14. Tailpiece rotation rotates a drive link 163 coupled via a lost motion slot 164 with a driven link 165 connected to the deadbolt. Tailpiece rotation pivots the links 163, 165 sufficiently over-center to positively retain the deadbolt in the thrown position for reception into a mating keeper plate 166 (FIG. 2) mounted at the adjacent door jamb 26. Further details of the specific deadbolt linkage mechanism and the operation thereof in response to the thumb turn 124 or keyed cylinder 126, are found by reference to U.S. Pat. No. 4,671,089, which is incorporated by reference herein.

Figure 24:
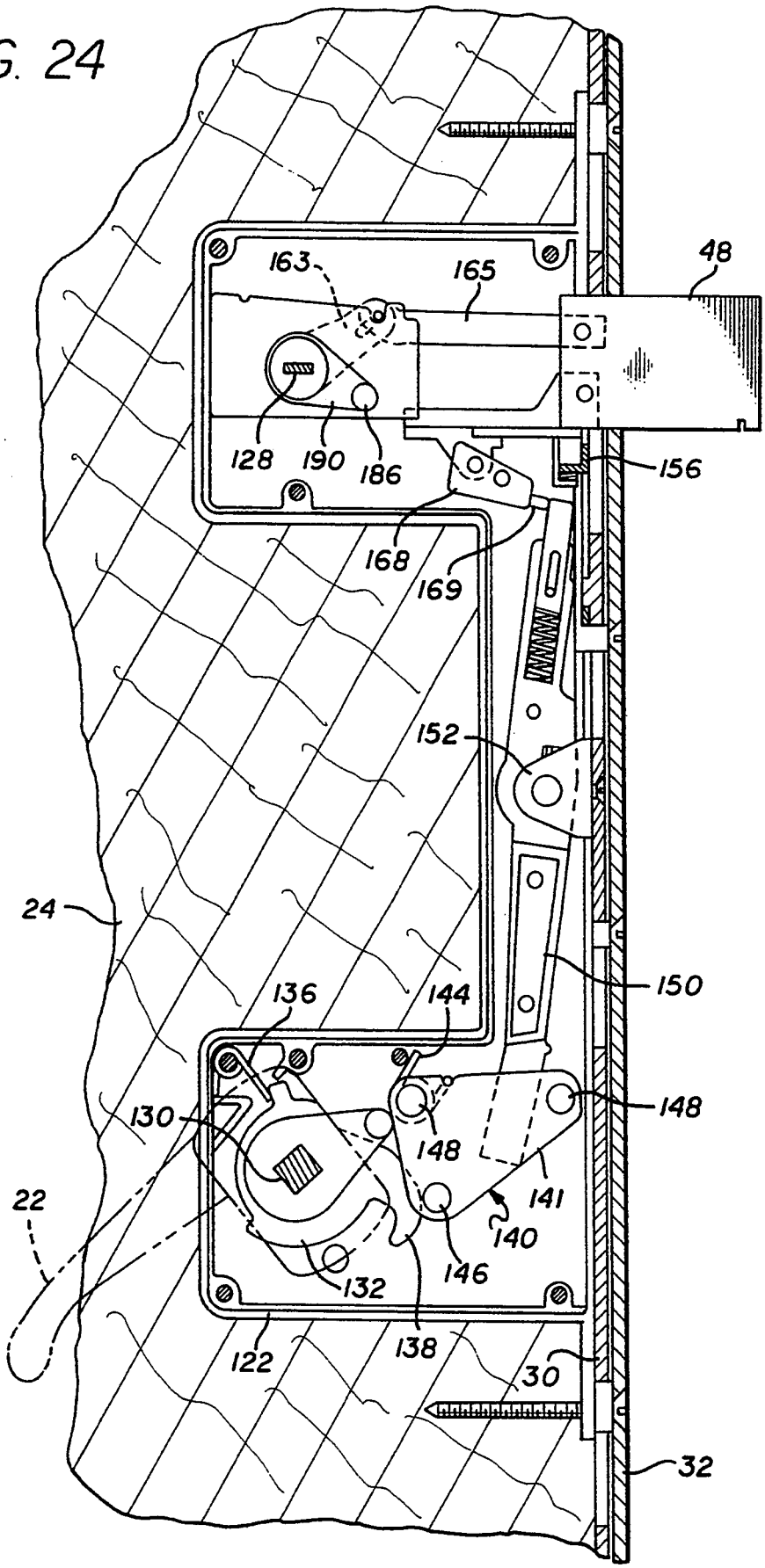
FIG. 24 is a fragmented vertical sectional view of the main actuator cartridge, viewed from the outdoor side of the door, and illustrating uncoupling of an outdoor lever handle from the actuator drive linkage when the deadbolt is in the thrown position.

Advancement of the deadbolt 48 to the thrown position, is accompanied by advancement of a trip pin 168 to a position engaging the rocker arm 150, as shown in FIGS. 23 and 24. The trip pin 168 rotates the rocker arm 150 through a short increment relative to the bracket 152. Importantly, this rotation of the rocker arm 150 is sufficient to displace the lower end thereof to a position out of alignment with the output pin 148 on the crank link 140. Thus, with the deadbolt advanced, pivoting movement of the crank link 140 in response to lever handle rotation is ineffective to lift the rocker arm 150, and therefore is also ineffective to retract the latch pins 16 for door opening. Instead, as shown in FIGS. 23 and 24, lever handle rotation with the deadbolt 48 in the thrown position causes the crank link 140 to pivot the output pin 148 upwardly past the rocker arm lower end, with the rocker arm lower end fitting without interference into the space between crank link plates 141. Conveniently, the trip pin 168 is pivotally mounted for sliding movement with the deadbolt 48, and includes a spring-loaded tip 169 for resiliently engaging the upper end of the rocker arm 150.

Figure 25:
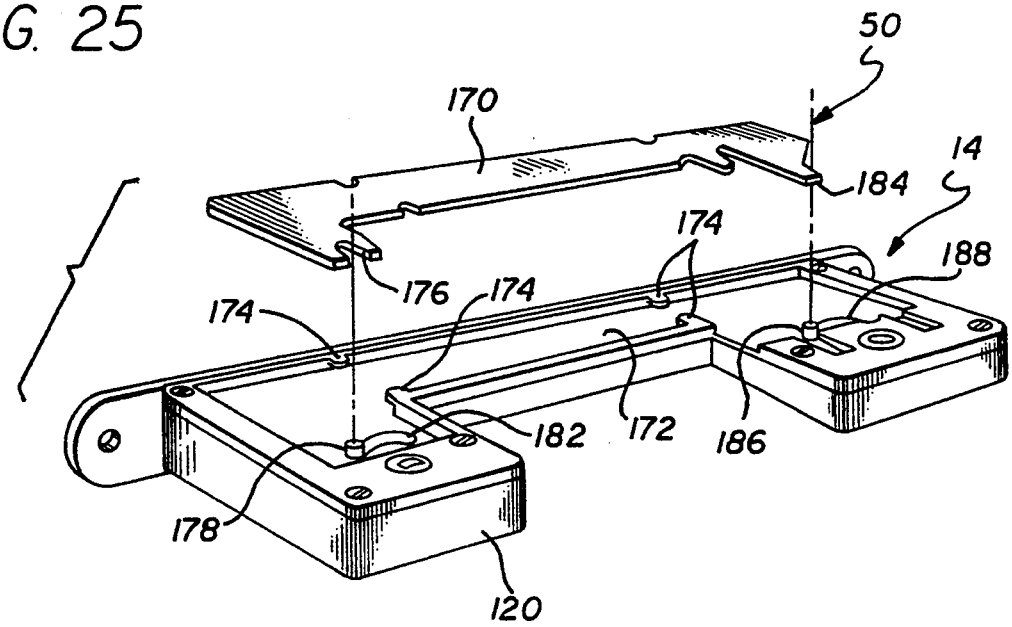
FIG. 25 is an exploded perspective view illustrating assembly of a panic release plate with the main actuator cartridge.

The panic release mechanism 50 provides a secondary linkage permitting panic-operated retraction of the deadbolt 48 and the latch pins 16 from the indoor side only. In this regard, the panic release mechanism comprises a panic release plate 170 mounted on the exterior of the actuator cartridge housing 120, as shown in FIG. 25. The panic release plate 170 has a notched shape for slide-fit reception into a recessed track 172 disposed beneath sets of alignment fingers 174, with similar recessed tracks 172 being formed on both of the opposite sides of the cartridge housing 120. When the actuator cartridge 14 is installed into the door side edge 18, the panic release plate 170 is mounted into the track 172 disposed on the indoor side of the housing 120.

The panic release plate 170 includes a cam slot 176 in one end associated with the indoor lever handle 20, for receiving a cam pin 178 on a drive cam 180 mounted for rotation with the indoor lever handle 20. A similar drive cam 180 with protruding cam pin 178 (FIG. 15) is mounted for rotation with the outdoor lever handle 22, to engage the panic release plate 170 when the cartridge 14 is installed in an opposite-handed swinging door installation. The cam pin 178, as shown in FIG. 25 on the indoor side of the actuator housing, projects from the cartridge housing 120 through an associated semicircular groove 182 for reception into the cam slot 176 of the panic release plate 170.

Panic-operated rotation of the indoor lever handle (FIGS. 26 and 27) thus shifts the position of the panic release plate 170 within the housing track 172. This motion engages a cam follower arm 184 on the panic release plate 170 with a second cam pin 186 rotatable with the deadbolt linkage. This latter cam pin 186 also protrudes from the cartridge housing 120 through an associated semicircular groove 188 for driven engagement by the cam follower arm 184, to rotate a drive cam lobe 190 mounted within the cartridge housing 120 for rotation with the deadbolt drive link 163. Panic-operated shifting of the panic release plate 170 thus causes the cam follower arm 184 to operate the deadbolt mechanism in a direction retracting the deadbolt. Importantly, initial retraction of the deadbolt is accompanied by retraction of the trip pin 168 from the rocker arm 150. As a result, the spring-loaded rocker arm returns rapidly to the normal operational position oriented for lifting engagement by the crank link 140, in response to rotation of the indoor lever handle 20. Thus, although the outdoor lever handle 22 is disabled upon deadbolt advancement, indoor handle actuation is effective via the panic release plate 170 to achieve rapid panic-release unlocking and opening of the door.

The multipoint lock assembly 10 of the present invention thus provides a high security lock assembly which can be configured quickly and easily for left- or right-handed swinging door installation, wherein secure and tight door closure is achieved whenever the door is in a closed condition. The latch pins 16 and related operating mechanisms within the main actuator cartridge 14, as well as the strike plates associated with the latch pins 16 are essentially of a non-handed design suited to left- or right-handed swinging doors without modification. A deadbolt is provided for positive door locking, wherein the deadbolt is operable only when the door is in the closed condition. Adaption of the deadbolt for a left- or right-handed door installation is easily performed by mere reversed installation of the thumb turn and keyed cylinder. Panic release unlocking and opening of the door is provided upon simple actuation of the conventional indoor lever handle, with the panic release plate being mounted on the exterior of the actuator cartridge 14 to provide quick and easily customizing according to a left- or right-handed installation.

A variety of further modifications and improvements to the invention will be apparent to those skilled in the art. Accordingly, no limitation on the invention is intended by way of the foregoing description and accompanying drawings, except as set forth in the appended claims.

What is claimed is:

1. A door lock assembly for use in locking a swinging door, said lock assembly comprising:

a plurality of latch pins mounted at spaced positions along a side edge of a swinging door for movement between an advanced position projecting outwardly from the door side edge, and a retracted position withdrawn substantially into the door side edge;

means for supporting said latch pins for displacement in a first direction along the door side edge concurrently with movement to said advanced position, and in a second opposite direction along the door side edge concurrently with movement to said retracted position;

actuator means for displacing said latch pins between said advanced and retracted positions, said actuator means including means for normally positioning and retaining said latch pins in said advanced positions;

trigger means responsive to movement of said latch pins to said retracted position for retaining said latch pins in said retracted position, said trigger means including means responsive to closure of the door for releasing said latch pins for return movement to said advanced position; and a plurality of strike plates for mounting onto a door jamb in a position adjacent to the side edge of the swinging door when the door is in a closed position, said strike plates each including a ramped edge engaged by a respective one of said latch pins upon movement to said advanced position for drawing the door to a tightly closed condition.

2. The door lock assembly of claim 1 wherein said means for normally positioning and retaining said latch pins in said advanced position comprises at least one spring.

3. The door lock assembly of claim 1 wherein said latch pins are mounted at vertically spaced positions along a vertically extending side edge of the swinging door.

4. The door lock assembly of claim 1 wherein said latch pins are mounted at vertically spaced positions along a vertically extending side edge of the swinging door, said latch pins being displaced vertically downwardly concurrently with movement to said advanced position, and vertically upwardly concurrently with movement to said retracted position.

5. The door lock assembly of claim 1 wherein said actuator means further includes a deadbolt movable between a thrown position protruding from the door side edge and a retracted position withdrawn substantially into the door side edge, and means for displacing said deadbolt between said thrown and retracted positions.

6. The door lock assembly of claim 5 wherein said actuator means further includes means for preventing movement of said deadbolt to said thrown position when said latch pins are substantially in said retracted position.

7. The door lock assembly of claim 5 wherein said actuator means includes indoor and outdoor rotatable handle means disposed respectively at indoor and outdoor sides of the swinging door, and a drive linkage coupled between said indoor and outdoor handle means and said latch pins for displacing said latch pins between said advanced and retracted positions in response to rotation of either one of said indoor and outdoor handle means.

8. The door lock assembly of claim 7 wherein said actuator means further includes means for uncoupling said indoor and outdoor handle means from said drive linkage when said deadbolt is in the thrown position.

9. The door lock assembly of claim 8 further including a panic release mechanism responsive to rotation of said indoor handle means for displacing said deadbolt to said retracted position and for displacing said latch pins to said retracted position.

10. The door lock assembly of claim 9 wherein said actuator means comprises an actuator housing having a recessed track formed on the exterior thereof, and wherein said panic release mechanism comprises a cam plate mounted within said recessed track.

11. The door lock assembly of claim 10 wherein said actuator housing has indoor and outdoor sides each having a recessed track formed therein on the exterior thereof, and wherein said cam plate is mounted within said recessed track on the indoor side of said actuator housing.

12. The door lock assembly of claim 1 wherein each of said latch pins has a roller head thereon for rolling engagement with the ramped edge of the associated one of said strike plates.

13. The door lock assembly of claim 1 wherein said plurality of latch pins comprise three of said latch pins mounted at spaced positions along said door side edge.

14. The door lock assembly of claim 1 wherein each of said strike plates has a central opening formed therein of closed loop geometric shape, and with one side edge thereof defining said ramped edge.

15. The door lock assembly of claim 14 wherein each of said strike plates has a pair of said ramped edges to permit reversible installation on a door jamb for either one of left- or right-handed swinging movement of the door to the closed position.

16. A door lock assembly for use in locking a swinging door, said lock assembly comprising:

at least one latch pin mounted along a side edge of a swinging door for movement between an advanced position projecting outwardly from the door side edge, and a retracted position withdrawn substantially into the door side edge, said latch pin moving in a first direction along the door side edge concurrently with movement to said advance position, and in an opposite direction along the door side edge concurrently with movement to said retracted position;

spring means for urging said latch pin normally to said advanced position;

actuator means on the door operable to displace said latch pin from said advanced position to said retracted position;

trigger means responsive to movement of said latch pin to the retracted position for retaining said latch pin in the retracted position, said trigger means including a trigger pin responsive to closure of the door for releasing the latch pin for spring-loaded return movement to said advanced position; and a strike plate for mounting onto a door jamb in a position adjacent to the door side edge when the door is closed, said strike plate having a ramped edge engaged by said latch pin upon movement of said latch pin to the advanced position for drawing the door to a tightly closed position.

17. The door lock assembly of claim 16 wherein said strike plate has a pair of said ramped edges to permit reversible installation onto a door jamb adapted for either one of left- and right-handed swinging movement of the door to the closed position.

18. The door lock assembly of claim 17 wherein said actuator means further includes a deadbolt movable between a thrown position protruding from the door side edge and a retracted position withdrawn substantially into the door side edge, and means for displacing said deadbolt between said thrown and retracted positions.

19. The door lock assembly of claim 18 wherein said actuator means further includes means for preventing movement of said deadbolt to said thrown position when said latch pin is substantially in said retracted position.

20. The door lock assembly of claim 18 wherein said actuator means includes indoor and outdoor rotatable handle means disposed respectively at indoor and outdoor sides of the swinging door, and a drive linkage coupled between said indoor and outdoor handle means and said latch pin for displacing said latch pin between said advanced and retracted positions in response to rotation of either one of said indoor and outdoor handle means.

21. The door lock assembly of claim 20 wherein said actuator means further includes means for uncoupling said indoor and outdoor handle means from said drive linkage when said deadbolt is in the thrown position.

22. The door lock assembly of claim 21 further including a panic release mechanism responsive to rotation of said indoor handle means for displacing said deadbolt to said retracted position and for displacing said latch pin to said retracted position.

23. The door lock assembly of claim 16 wherein said latch pin has a roller head thereon for rolling engagement with said ramped edge of said strike plate.

24. The door lock assembly of claim 16 wherein said strike plate has a central opening formed therein of closed loop geometric shape, and with one side edge thereof defining said ramped edge.

25. A door lock assembly for use in locking a swinging door, said lock assembly comprising:

a plurality of latch pin units mounted at spaced positions along a side edge of a swinging door, each of said latch pin units including a latch pin movable between an advanced position projecting outwardly from the door side edge and a retracted position withdrawn substantially into the door side edge, and cam means movable back and forth in a direction along the door side edge for displacing said latch pin in a first direction along the door side edge concurrently with movement to said advanced position and in a second opposite direction along the door side edge concurrently with movement to said retracted position;

an elongated drive bar extending generally along the door side edge for movement back and forth in a direction along the door side edge, said drive bar being coupled to said cam means for moving said latch pins of said latch pin units between said advanced and retracted positions;

actuator means including a drive linkage and indoor and outdoor handle means for operating said drive linkage to shift said drive bar in a first direction along the door side edge to move said latch pins from said advanced position to said retracted position;

spring means for normally urging said drive bar to shift in a second direction along the door side edge to move said latch pins from said retracted position to said advanced position;

trigger means responsive to movement of said latch pins to said retracted position for retaining said latch pins at said retracted position, said trigger means including means responsive to movement of the door to a closed position to release said latch pins for spring-loaded movement from said retracted position to said advanced position; and a plurality of strike plates mounted on a door jamb adjacent to the door side when the door is closed, each of said strike plates being aligned generally with an associated one of said latch pins and including a ramped edge for engagement by said associated latch pin to draw the door side edge to a tightly closed position.

26. The door lock assembly of claim 25 wherein each of said latch pins has a roller head for rolling engagement with the ramped edge of the associated one of said strike plates.

27. The door lock assembly of claim 25 wherein each of said strike plates has a pair of said ramped edges to permit reversible installation onto a door jamb adapted for either left- and right-handed swinging movement of the door to the closed position.

28. The door lock assembly of claim 25 wherein said drive bar is mounted within a recessed channel formed in the door side edge.

29. The door lock assembly of claim 25 wherein said spring means comprises at least one spring mounted within one of said latch pin units for reaction between said one latch pin unit and said drive bar.

30. The door lock assembly of claim 25 wherein said trigger means comprises a trigger assembly mounted within one of said latch pin units for engaging a trigger stop on said drive bar, said trigger assembly further including a trigger pin for engaging a trigger strike mounted on the adjacent door jamb upon movement of the door to the closed position to release said latch pins.

31. The door lock assembly of claim 25 wherein said actuator means further includes a deadbolt movable between a thrown position protruding from the door side edge and a retracted position withdrawn substantially into the door side edge, and means for displacing said deadbolt between said thrown and retracted positions.

32. The door lock assembly of claim 31 wherein said actuator means includes an actuator housing, said means for displacing said deadbolt comprising a thumb turn and a keyed cylinder reversibly mountable on opposite sides of said actuator housing to define indoor and outdoor sides thereof, said thumb turn being mounted on the indoor side of said actuator housing and said keyed cylinder being mounted on the outdoor side thereof.

33. The door lock assembly of claim 31 wherein said actuator means further includes means for preventing movement of said deadbolt to said thrown position when said latch pins are substantially in said retracted position.

34. The door lock assembly of claims 31 wherein said actuator means further includes means for uncoupling said indoor and outdoor handle means from said drive linkage when said deadbolt is in the thrown position.

35. The door lock assembly of claim 34 wherein said drive linkage includes a pivot link movable with said indoor and outdoor handle means, a pivotal rocker arm carried by said drive bar, and spring means for retaining said rocker arm in a normal position for engagement by said pivot link upon rotation of either one of said indoor and outdoor handle means, said means for uncoupling said indoor and outdoor handle means from said drive linkage comprising a trip pin carried with said deadbolt for pivotably moving said rocker arm, when said deadbolt is thrown, to a position out of engagement with said pivot link upon rotation of said handle means, whereby rotation of said handle means is ineffective to displace said drive bar.

36. The door lock assembly of claim 34 further including a panic release mechanism responsive to rotation of said indoor handle means for displacing said deadbolt to said retracted position and for displacing said latch pins to said retracted position.

37. The door lock assembly of claim 36 wherein said actuator means comprises an actuator housing having a recessed track formed on the exterior thereof, and wherein said panic release mechanism comprises a cam plate mounted within said recessed track.

38. The door lock assembly of claim 37 wherein said actuator housing has indoor and outdoor sides each having a recessed track formed therein on the exterior thereof, and wherein said cam plate is mounted within said recessed track on the indoor side of said actuator housing.

39. The door lock assembly of claim 25 wherein each of said strike plates has a central opening formed therein of closed loop geometric shape, and with one side edge thereof defining said ramped edge.

40. A door lock assembly for use in locking a swinging door, said lock assembly comprising:

at least one latch pin mounted along a side edge of a swinging door for movement between an advanced position projecting outwardly from the door side edge, and a retracted position withdrawn substantially into the door side edge;

actuator means for displacing said latch pin between said advanced and retracted positions, said actuator means including means for normally positioning and retaining said latch pin in said advanced position;

a deadbolt movable between a thrown position protruding from the door side edge and a retracted position withdrawn substantially into the door side edge;

means for displacing said deadbolt between said thrown and retracted positions;

said actuator means further including indoor and outdoor rotatable handle means disposed respectively at indoor and outdoor sides of the swinging door, and a drive linkage coupled between said indoor and outdoor handle means and said latch pin and operable for displacing said latch pin between said advanced and retracted positions in response to rotation of either one of said indoor and outdoor handle means;

means for uncoupling said indoor and outdoor handle means from said drive linkage when said deadbolt is in the thrown position, whereby rotation of either one of said indoor and outdoor handle means when said deadbolt is in the thrown position is ineffective to operate said drive linkage to displace said latch pin between said advanced and retracted positions;

a panic release mechanism responsive to rotation of said indoor handle means when said deadbolt is in the thrown position to displace said deadbolt to said retracted position and to displace said latch pin to said retracted position; and trigger means responsive to movement of said latch pin to said retracted position for retaining said latch pin in said retracted position, said trigger means further including means responsive to closure of the swinging door for releasing said latch pin for return movement to said advanced position.

41. The door lock assembly of claim 40 wherein said actuator means comprises an actuator housing having a recessed track formed on the exterior thereof, and wherein said panic release mechanism comprises a cam plate mounted within said recessed track.

42. The door lock assembly of claim 41 wherein said actuator housing has indoor and outdoor sides each having a recessed track formed therein on the exterior thereof, and wherein said cam plate is mounted within said recessed track on the indoor side of said actuator housing.

* * * * *